United States Patent [19]

Dick

[11] 4,436,103

[45] Mar. 13, 1984

[54] COIN COLLECTING AND COUNTING SYSTEMS

[75] Inventor: Neil M. Dick, Schenectady, N.Y.

[73] Assignee: 4-D Electronics Company, Inc., Schenectady, N.Y.

[21] Appl. No.: 208,390

[22] Filed: Nov. 19, 1980

[51] Int. Cl.[3] ..... G07D 3/16

[52] U.S. Cl. ..... 133/3 D; 133/8 R

[58] Field of Search ..... 133/3 C, 3 D, 3 R, 3 F, 133/3 G, 3 E, 8 R, 3 H, 8 A; 194/1 K, 1 N, DIG. 23, 97, 1 A, 1 B

[56] References Cited

U.S. PATENT DOCUMENTS

| | | | |
|---|---|---|---|
| 2,594,422 | 4/1952 | Gordon | 133/8 R |
| 3,048,251 | 8/1962 | Bower | 133/8 R |
| 3,142,370 | 7/1964 | Otten | 194/DIG. 23 |
| 3,754,558 | 8/1973 | Conant et al. | 133/3 R |
| 3,815,718 | 6/1974 | Singer | 194/1 N |
| 3,930,512 | 1/1976 | Woodland | 133/8 R |
| 3,941,227 | 3/1976 | Gordon | 194/1 K |
| 4,059,122 | 11/1977 | Kinoshita | 133/3 D |

*Primary Examiner*—Stanley H. Tollberg

*Attorney, Agent, or Firm*—LeBlanc, Nolan, Shur & Nies

[57] ABSTRACT

Automatic coin collection and counting apparatus for toll and other applications including a unit in which coins move in single file and in a specific orientation past a detector system that generates signals indicative of denomination and circuitry responsive to those signals for ascertaining the monetary value of the coins and for actuating peripheral equipment coincidentally with the valuation.

41 Claims, 14 Drawing Figures

40
4
42
56
76
64
44
148
150
50
530
532
72
78
46
62
80
74
52
92
82
84
48
58
54
140
224
141
102
122
120
60
124
106
100
176
98
5
162
160
196
4
170
195
166
180
5

72
81
70
82
108
86
92
80
84
88
78
24
144
146
155
148
152
154
153
156
42
56
142
68
66
90
110
106
98
539
520
100
96
94
76
44
72
81
88
84
78
110
80
88
92
62
141
46
140
58
40
132
128
126
112
130
182
184
120
122
118
132
224

198
200
160
195
224
62
170
46
214
166
182
192
186
172
174
204
202
168
178
218
190
210
206
208
220
184
216
194
188
212
180

140
120
46
122
54
60
132-3
132-1
132-5
132-2
132-6
132-4
134
7
7
198
208
466
162
200
176
170
164

112
122
124
114-5
114-3
114-6
114-1
120
118
62
133-6
133-1
60
133-5
133-3
46
132-6
66
126
128
116-6
116-1
132-1
116-5
116-3
130
132-5

+10V
230-1
232-1
232-2
232-3
232-4
232-5
232-6
232-7
238-1
238-2
238-3
238-4
238-5
238-6
240-1
240-2
240-3
240-4
240-5
240-6
242-1
242-2
242-3
242-4
242-5
242-6
A
B
C
D
E
F
G
DIME
PENNY
NICKEL
QUARTER
DOLLAR
HALF DOLLAR
230-2
230-3
230-4
230-5
230-6
230-7
116-1
116-2
116-3
116-4
116-5
116-6
138
114-1
114-2
114-3
114-4
114-5
114-6
136
256
258
260
262
1
4
8
9
13

+5V
296
298
308
312
310
320
322
314
316
324
318
374
284
292
286
282
278
346
272
281
274
344
280
370
364
366
368
362
348
350
360
264
326
328
330
RCE
270-1
270-2
270-3
270-4
270-5
270-6
268-1
268-2
268-3
268-4
268-5
244-1
244-2
244-3
244-4
244-5
342-1
342-2
342-3
342-4
342-5
266-1
266-2
266-3
266-4
266-5
263
TO REMOTE COUNTER
A
B
C
D
E
F
G
H
Z

332
+5V
H
376
380-4
380-3
380-2
380-1
+5V
8
4
2
1
387
382-4
382-3
382-2
378
382-1
335-1
335-2
335-3
335-4
336-1
336-2
336-3
336-4
372-1
372-2
372-3
372-4
338-1
338-2
338-3
338-4
386
334
396
398
388
390
H'
456
394
452
454
442
M
N
393
395
Z

+5V
+5V
+5V
+5V
+5V
+5V
462
466
472
474
458
470
460
464
435
467
468
523
522
407
408
412
402
404
406
410
400
418
419
V
Q
R
O
P
W
T
I

+5V
U
S
H'
Y
W
N
T
V
X
K
L
I
540
519
428
392
391
521
488
496
542
544
508
536
535
514
500
512
498
494
486
518
538
426
510
517
438
484
482
480
516
424
525
526
524
506
534
446
448
422
478
476
490
528
504
432
440
492

COIN COLLECTING AND COUNTING SYSTEMS

In one aspect the present invention relates to novel, improved systems for identifying and counting coins deposited at random in an appropriate repository.

In another aspect the present invention relates to novel improved systems for identifying coins deposited in a receptacle, for ascertaining the monetary value of the deposit, and for actuating peripheral equipment coincidentally with the calculation of the deposit.

And, in still another respect, the present invention relates to novel, improved toll equipment with coin handling and valuation systems and apparatus of the character described above.

The term "coin" is used herein in its normal sense; unless stated otherwise, it is also intended to include: (a) tokens, and (b) other coin-shaped objects which are non-monetary in character.

One particularly important application of my invention is in the collection of vehicular tolls; i.e., in toll booth equipment for highways, bridges, parking lots, and the like. The principles of the present invention will consequently to a large extent be developed primarily by reference to such applications. It is to be understood, however, that is being done primarily for the sake of clarity and conciseness and is not intended to limit the scope of the invention as defined in the appended claims, especially in view of the other uses to which my invention may be put. Among these are toll equipment for mass transit systems, for example.

Generally, the coin collection and counting systems I have invented include a coin separator unit designed to orient randomly deposited coins and direct them past an electronic coin denomination detection system. Signals generated by the latter and indicative of coin denomination are employed to provide a cumulative value of the deposited coins.

In toll or fare collection systems a fare paid signal is generated when coins totalling a selected amount have been counted. This signal can be employed to operate lights, barriers, and other traffic control devices; to reset the coin counting circuitry; and for other purposes.

Among the salient features of the coin separator unit is a motor driven separator that is capable of marshalling coins deposited at random in single file past a diameter responsive, electro-optical coin denomination detection system. The separator is essentially jam proof; and it has other significant attributes— for example, it will prevent coins from reaching the electro-optical denomination detecting system on edge or on top of each other.

Other important features of the coin separator unit are a scavenge dump and an escrow display.

The scavenge dump can be operated automatically, or manually, to dump bent coins or foreign objects from the separator unit.

The escrow display is important in toll collection applications of my invention. It retains coins—and foreign objects such as slugs—in a visually accessible section of the unit after the denominations of the coins are totalized. In the case of a toll violation, therefore, evidence of the violation is readily available. Physical access to the interior of the escrow display is also afforded, allowing the evidence segregated in the escrow display to be removed. Alternatively, the dump from the escrow display can be locked open, allowing coins to move directly from the coin denomination detecting system into a coin vault or other depository.

In normal, fare paid operation, the coins held in the escrow display can be automatically transferred to a coin vault or other depository once it has been determined by the coin counting part of the equipment that the proper fare has been deposited.

Another feature of the separator unit is a novel arrangement that operates automatically if the separator does become jammed to reverse the direction of rotation of the separator motor and, if desired, to operate the scavenge dump. Jams are rapidly and automatically cleared as a consequence; and damage to the separator is avoided.

Other features of the coin separator unit include a construction and a selection of materials that insure its continued, maintenance free operation for periods of long duration, even under the adverse conditions found at a typical toll station.

As indicated above, the coin identifying and valuing parts of my systems operate on the premise that the coins of various denominations in a particular currency have different diameters and that the denominations of randomly deposited coins can accordingly be identified by way of their diameters. Signals thus representative of coin denomination are processed for their information content, and the information on denomination is accumulated in counters which are incremented by counts indicative of monetary value. These steps are preferably carried out by solid state devices; and the process of identifying and valuing an assortment of randomly deposited coins is consequentially a rapid, error free process.

In toll collection applications of my invention a fare paid signal is generated when the accumulated count reaches a selected total. Another important feature of my invention is that this total can be reset easily, and manually, or programmed by a microprocessor or computer, for example.

The fare paid signal can be employed for a variety of purposes—for example, to operate traffic control devices and fare paid counters and to reset the coin counting circuitry so that a subsequent fare can be counted while other operations such as those just described are still in the process of being completed.

In toll applications involving exit barriers, this last-mentioned feature can result in the counting of more than one fare before the first of several patrons has cleared the exit barrier. Another feature of my invention, in this regard, is a novel fare paid memory arrangement that will cause the barrier to remain out of the way until it has been cleared by all of those patrons who have paid fares.

Conventionally, tolls are assessed in monetary units that can be paid by depositing the correct number of coins of lower value than the fare. Frequently, a patron will deposit more of the lower value coins than necessary with the excess being effectively credited to the next patron. This represents a loss of revenue that is eliminated by the novel use of the fare paid signal in toll applications of my invention to reset the coin value counters to zero.

Another feature of my invention in toll collection applications is that advantage can be taken of existing entry and exit or cancellation loops of the several types currently available. A cancellation loop derived signal may be employed, for example, to reset traffic control signals; to activate violation alarms and counters; to energize the escrow dump solenoid and thereby effect the transfer of the escrow coins to a coin vault or other repository if a fare paid signal appears and to prevent such transfer if a violation signal appears; and to activate the coin separator unit dump solenoid if a selected number of successive violation signals appear. This frees the unit of bent coins and foreign objects which may have become trapped by the separator and thereby kept coins from reaching the coin denomination detection system.

A cancellation loop derived signal can also be employed—in conjunction with a signal derived from an entry loop—to deactivate the separator unit motor when no patrons are present at the toll station. This reduces wear and tear on the moving parts of the separator unit, minimizing maintenance requirements and extending its service life. Energy consumption is also reduced.

Still another important feature of the coin denomination detecting and counting sections of my novel systems is that light emitting diodes (LEDs) are provided on the output sides of major circuits; they accordingly light when the associated circuits function properly. This novel innovation facilitates routine service checks and trouble shooting in the event that a malfunction occurs.

My invention is also readily equippable with a variety of options, making it capable of meeting virtually any customer specifications. For example, in toll station applications involving a barrier, a photoelectrically operated override can be easily added to keep a barrier from descending on a patron or vehicle in its path, irrespective of information concerning the presence or absence of the patron or vehicle supplied from other sources such as a cancellation loop.

Manual switch controlled operation of the barrier in such applications can also easily be provided; and other manual overrides—for example of the separator unit motor—can be furnished.

Exemplary of still other novel and important features of my invention is a coin vault operated switch that prevents the coin counting and other systems from operating unless a coin vault is locked in place. This is important because of the impediment to theft by a dishonest toll collector this affords.

Many coin sorting and counting systems have heretofore been proposed with those disclosed in the following U.S. patents perhaps most nearly resembling mine: U.S. Pat. No. 1,374,468 issued Apr. 12, 1921, to Paul; U.S. Pat. No. 2,594,422 issued Apr. 29, 1952, to Gordon; U.S. Pat. No. 3,048,251 issued Aug. 7, 1962, to Bower; U.S. Pat. No. 3,086,536 issued Apr. 23, 1963, to Klopp; U.S. Pat. No. 3,125,102 issued Mar. 17, 1964, to Bower; U.S. Pat. No. 3,680,566 issued Aug. 1, 1972, to Tanaka et al; U.S. Pat. No. 3,699,981 issued Oct. 24, 1972, to Conant et al; U.S. Pat. No. 3,930,512 issued Jan. 6, 1976, to Woodland; U.S. Pat. No. 3,998,237 issued Dec. 21, 1976, to Kressin et al; U.S. Pat. No. 4,082,099 issued Apr. 4, 1978, to Iwersen; U.S. Pat. No. 4,088,144 issued May 9, 1978, to Zimmermann; and U.S. Pat. No. 4,178,502 issued Dec. 11, 1979, to Zimmermann.

Closer inspection shows, however, that the resemblance is only superficial.

Bower, for example, discloses what the patentee refers to as coin singling apparatus; and that apparatus, like mine, employs a rotating drum to marshal a randomly deposited assortment of coins into a single file. There, however, the resemblance between Bower's device and my invention ends. The Bower device has no capability for ascertaining the denomination of the deposited coins or their value and none of the features of my invention except for jam prevention. Even this, furthermore, is accomplished in a much different and more complex manner.

Those devices disclosed in Klopp, Tanaka et al., Conant et al., and Woodland are like my invention to the extent that the broad concept of electro-optical determination of coin denomination is employed. With the exception of that disclosed in Conant et al., however, these patented devices have little in common with my invention. The coin denomination indicative signals are generated and processed differently, and the information contained in those signals is used for different purposes.

Conant et al. disclose a technique for detecting the denomination of coins and for processing electrical signals indicative of coin denomination that resembles the system I use to some extent. However, there are also numerous differences. As an example, Conant et al. employ a technique in which denominations of coins are identified from n-1 sensor derived signals. For my purposes, in contrast, I employ a logic in which the number of coin denominations and the number of sensor derived, denomination indicative signals have a one-to-one relationship. Also, the signal processing circuitry I employ to extract information from the sensor derived signals is quite different, physically and in operating logic, from that employed in the patented device. Furthermore, the Conant et al. device is not designed for toll collection applications; and it has nothing which would make it capable of carrying out the many functions required of my coin sorting and counting apparatus in such applications. Nor is it of a construction suited for the adverse environments typically encountered in such applications.

The Paul, Gordon, Bower '251, Kressin et al., Iwersen, Zimmerman '144, and Zimmerman '502 patents further illustrate how the states of the coin sorting and toll collection arts have developed and where they now stand. There is, however, little resemblance beween the several pieces of apparatus disclosed in those patents and what I have invented.

From the foregoing it will be apparent to the reader that one primary object of the present invention resides in the provision of novel, improved systems for identifying and counting coins deposited at random in an appropriate repository.

An equally important, and primary, object of the invention is the provision of novel improved systems for identifying coins deposited in a receptacle, for ascertaining the monetary value of the deposit, and for actuating peripheral equipment coincidentally with the valuation of the deposit.

And still another important and primary object of my invention is to provide novel, improved toll equipment with coin handling and valuation systems and apparatus of the character identified in the preceding objects.

Other more specific but nevertheless important objects of my invention reside in the provision of coin sorting and counting apparatus of the character identified in the preceding objects:

which is capable of reliable, high speed, error free operation;

which has a long service life and is capable of maintenance free operation for extended periods;

in which such malfunctions as may occur are easily identified;

which is simple and consequently relative inexpensive to service;

which is capable of clearing itself of jams;

which is suited for applications involving adverse environmental conditions;

which is capable of counting all coins of which a particular currency may be constituted;

from which bent coins and foreign objects can be easily removed;

which has an escrow for visibly displaying coins which have been deposited and counted;

which can be so associated with a securable coin repository that coins cannot be processed therethrough unless the repository is in place to receive the coins;

which, when coins totalling a selected value have been counted, is capable of generating an operation initiating signal for ancillary equipment;

which, in conjunction with the preceding object, can be readily programmed with the wanted value;

which, in conjunction with the two preceding objects, is capable of sorting and counting a subsequent assortment of coins while the operations initiated by said signal are still in process;

which is capable of generating operating inputs for remote counting equipment coincidentally with other operations;

which has a mechanical separator for marshalling coins of randomly assorted denominations into a single file, an electro-optical system for generating signals indicative of the denominations of said coins, and solid state circuitry for processing the signals;

which is easily interfaced with existing equipment in toll collection and other applications;

which is readily provided with sensor operated or manual overrides in applications where such overrides can be employed to advantage;

which has various combinations of the foregoing attributes.

Still other important but relatively specific object of my invention reside in the provision of toll collection equipment which includes coin sorting and counting apparatus with various ones of the attributes identified above.

Related, also relatively specific objects of my invention reside in the provision of toll collection equipment as identified in the preceding object:

which is versatile and can readily be tailored, as necessary, to meet a customer's requirements;

in which provision is made for cutting off the motor of the coin separating and counting apparatus when no patrons are near the toll station and thereby decreasing wear and tear on said motor and components of the aforesaid apparatus driven by said motor;

which, in installations involving a lane gate or other barrier, is capable of a fare paid memory tape of operation in which the barrier will remain raised or aside until at least a specific number of patrons indicated by the coin sorting and counting apparatus to have paid their fares have cleared the barrier;

which, in installations involving a lane gate or other barrier, can be readily equipped with a presence sensing, protective system that will keep the barrier from returning to a passage restraining position while a patron is in the vicinity of the barrier irrespective of other inputs to the barrier operating mechanism;

which has visible displays that are activated by depositing coins for checking the operation of the components of the equipment;

which is capable of automatic operation but also has manual overrides for salient functions.

Other important objects and features and additional advantages of my invention will become apparent from the appended claims and as the ensuing detailed description and discussion proceeds in conjunction with the accompanying drawing in which:

FIG. 9 is a perspective bottom view of a cover and coin baffle assembly incorporated in the coin separator unit;

Figure 12A:
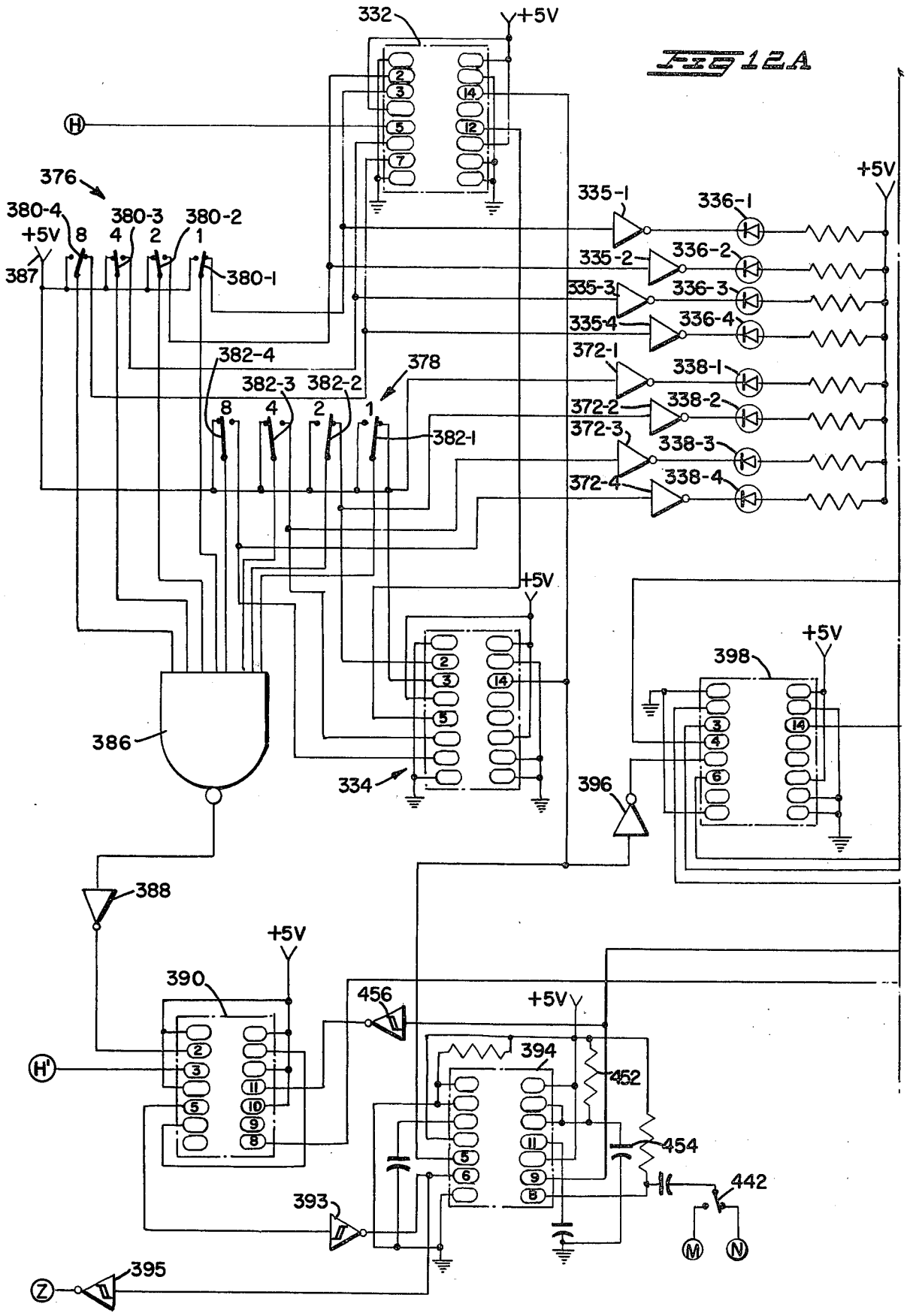
Figure 12B:
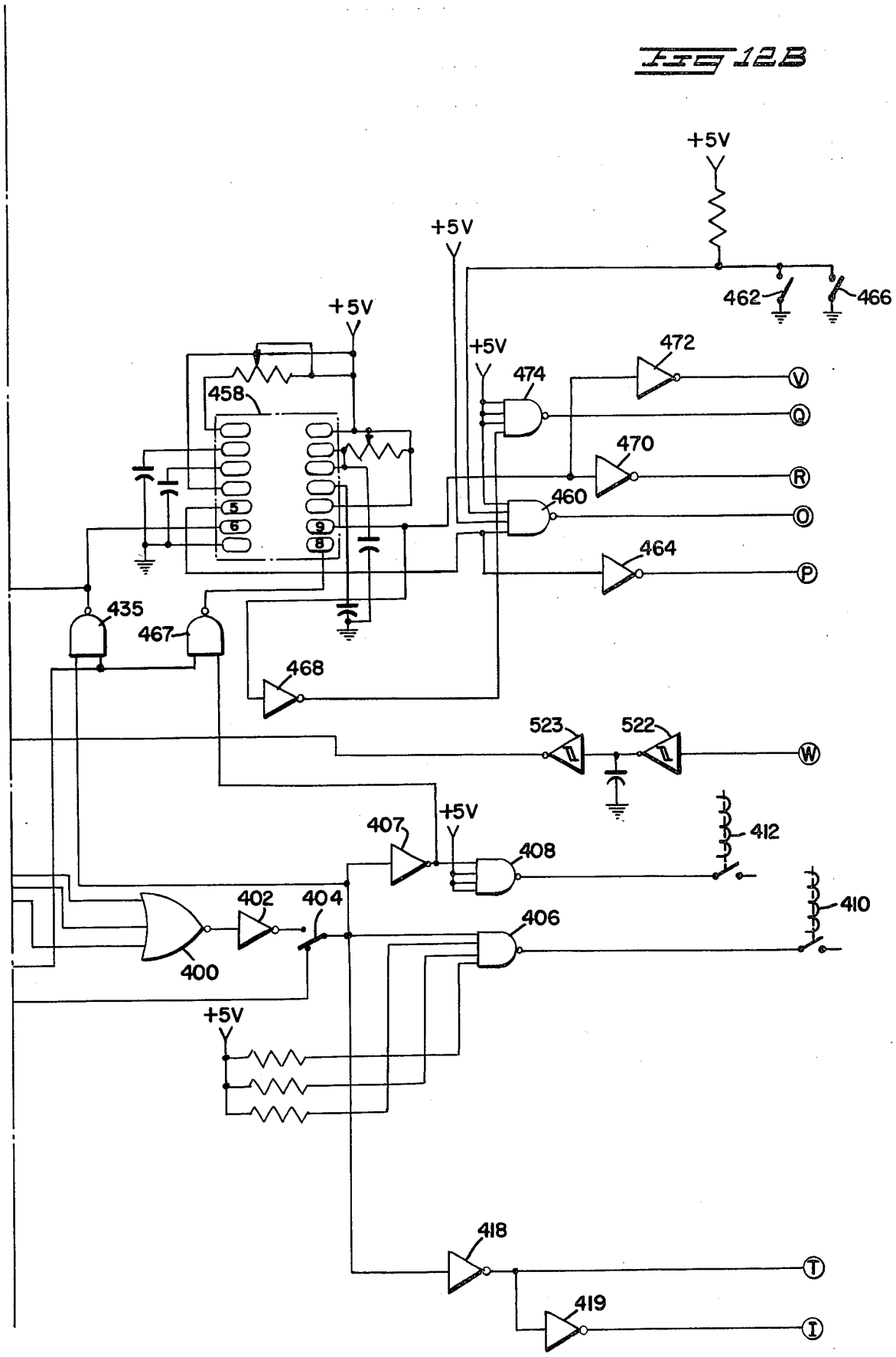
Figure 13:
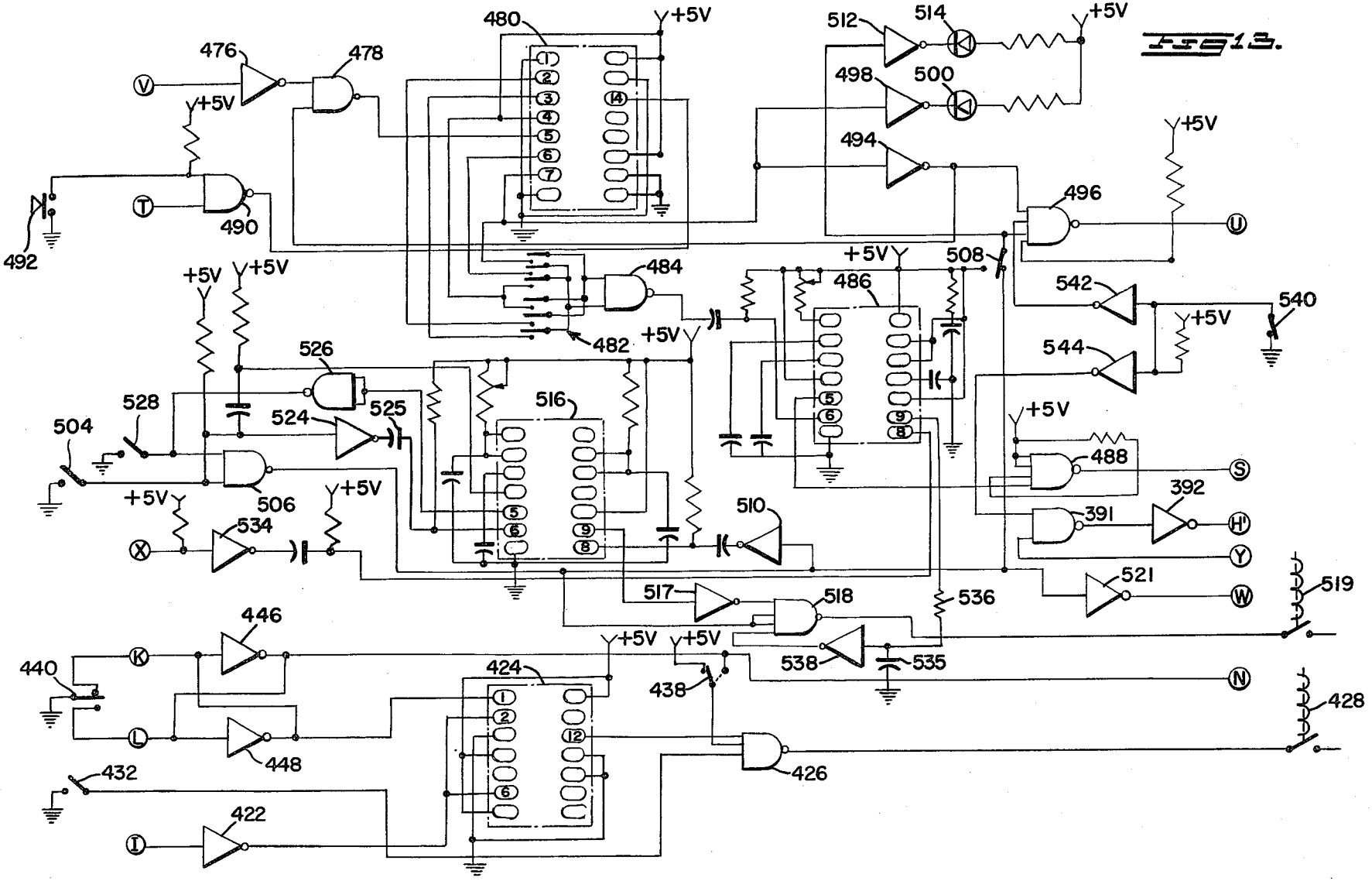

FIGS. 12A and 12B together constitute a schematic of control circuitry incorporated in the coin collection and counting system; and FIG. 13 is a schematic of additional control circuitry incorporated in the coin collection and counting system.

Figure 1:
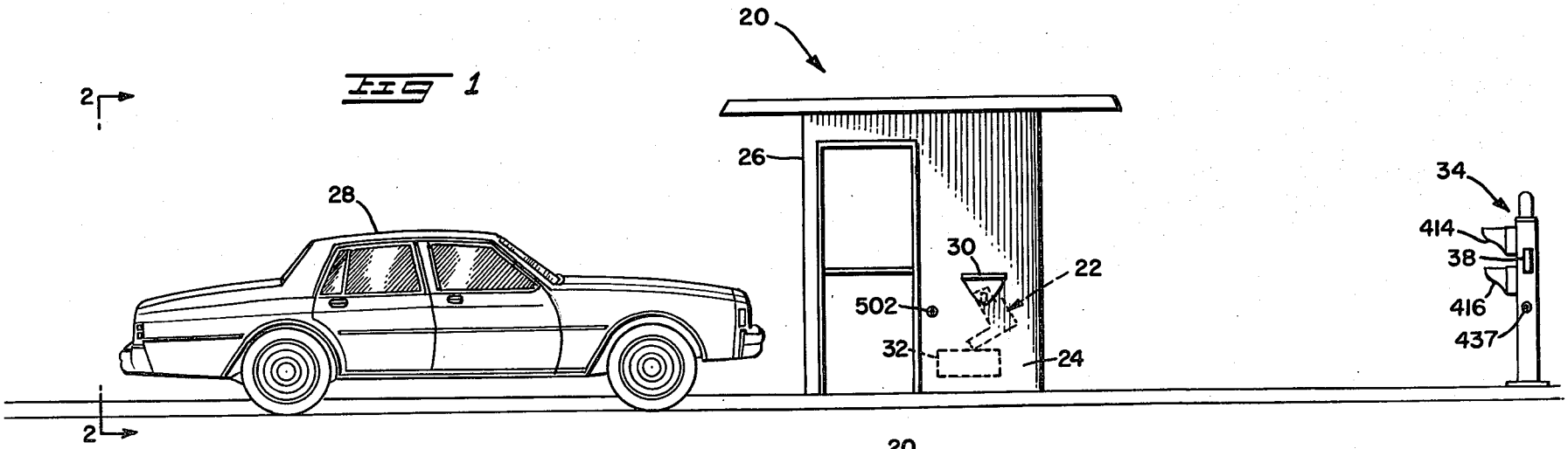
FIG. 1 is a pictorial illustration of an automobile approaching a toll booth equipped with an automatic coin collection and counting system embodying the principles of the present invention.
Figure 2:
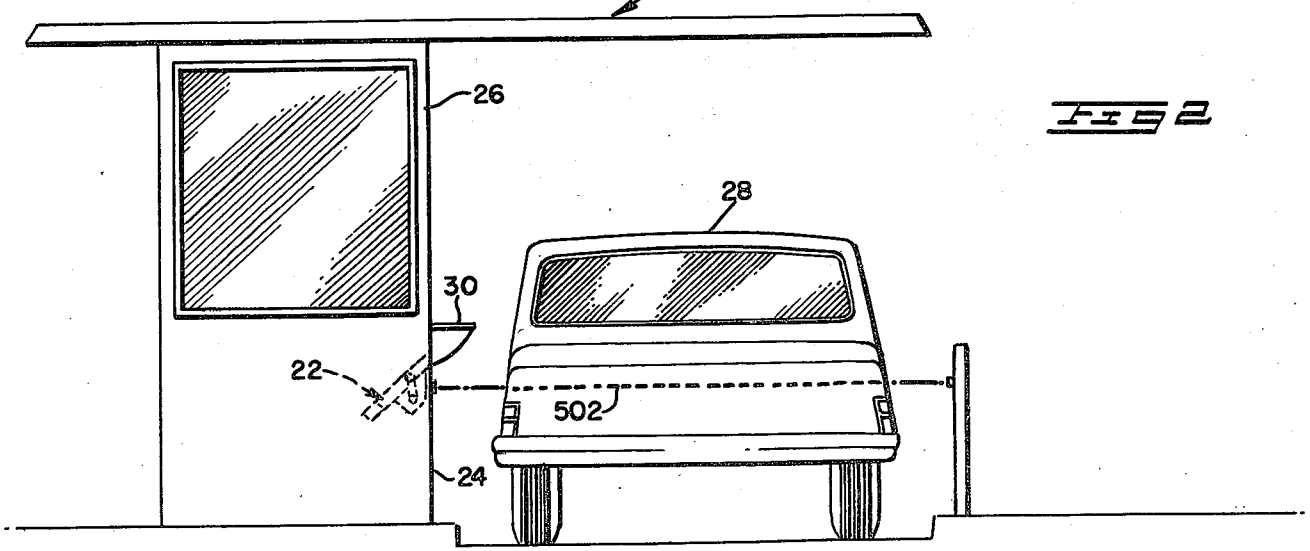
FIG. 2 is a pictorial view of the automobile and toll booth taken substantially along line 2—2 of FIG. 1.

Referring now to the drawing, FIGS. 1 and 2 depict a toll station 20 equipped with an automatic coin collection and counting system 22 constructed in accord with the principles of the present invention and mounted on the wall 24 of a toll booth 26.

Coins deposited by the operator of a vehicle 28 in a conventional basket 30 also mounted on toll booth wall 24 are identified by system 22 and then typically deposited in a conventional coin vault 32. The system also totals the fare paid and, if the fare is correct, actuates a traffic signal 34 from red to green and, typically, causes a gate 38 to be raised. If the vehicle proceeds without the proper fare having been deposited, the system will cause an alarm to be sounded; and any coins, slugs, and other foreign objects will be retained in an escrow display from which they can be removed as evidence of toll evasion.

In addition, the system is designed to actuate peripheral equipment capable of providing such information as total money deposited, number of fares paid, number of violations, etc.

Among the major components of system 22 is a coin separator unit 40 illustrated in FIGS. 3–8. That unit includes a platelike mounting bracket 42 to which a coin slide assembly 44 composed of a platform 46 and side walls 48 and 50 is bolted.

Figure 3:
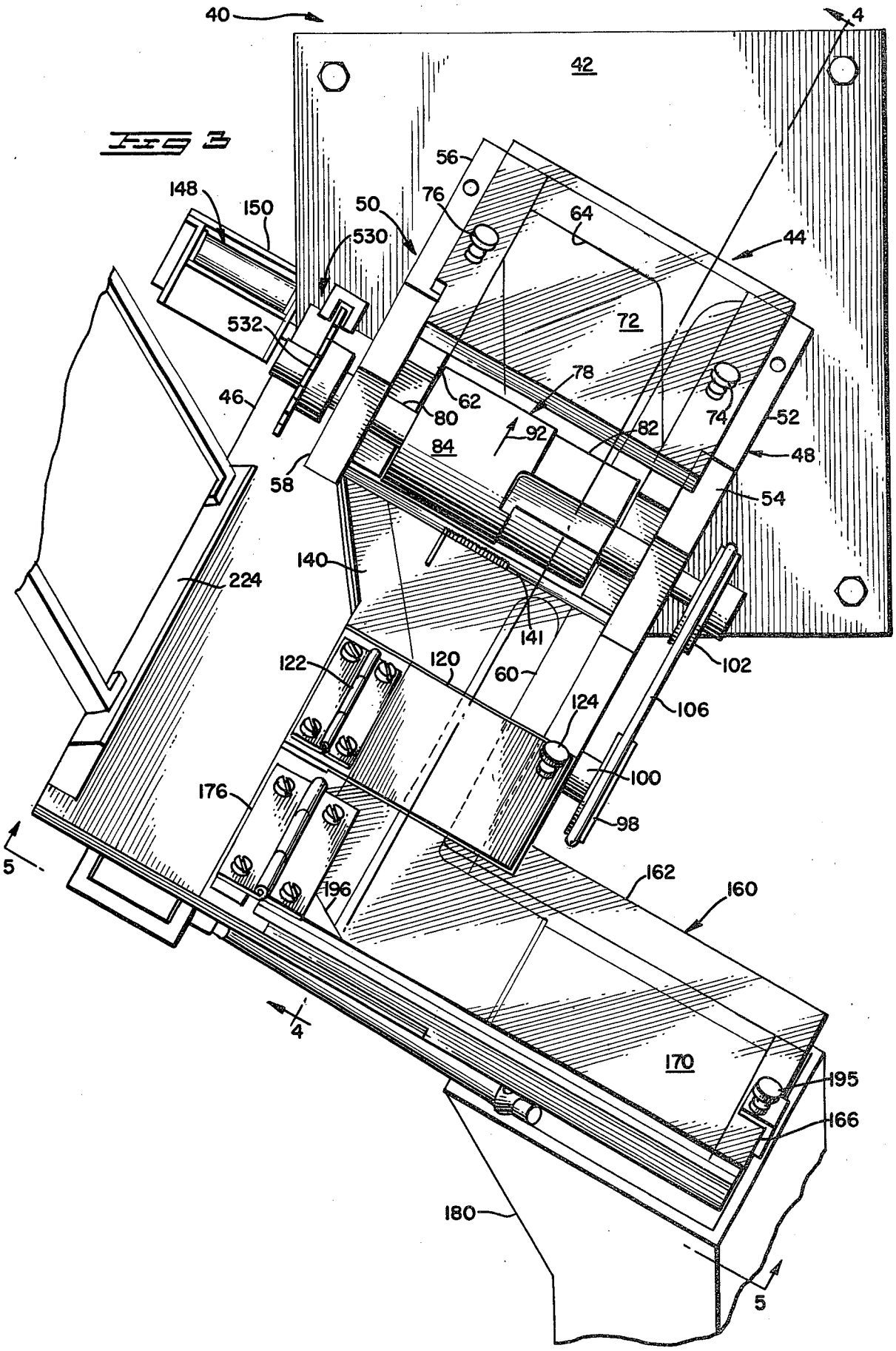
FIG. 3 is a perspective view of a coin separator unit employed in the coin collection and counting system.

The coin separator unit is shown in its installed orientation in FIG. 3. Mounting flange 42 is vertically oriented; and, from that flange, coin slide assembly platform 46 slants downwardly and to the left.

Lower coin slide assembly side wall 48 is composed of two members 52 and 54 typically fabricated from bar stock. They extend longitudinally along platform 46 at the lower edge thereof. The upper side wall 50 is composed of similar members 56 and 58 extending parallel to side wall 48 but spaced therefrom toward the upper edge of the platform.

Adjacent the walls or sides 48 and 50 of the coin slide assembly are rails 60 and 62. These, especially the lower rail 60, guide the coins as they slide down platform 46. The rails will typically be fabricated of stainless steel or other weather resistant material.

Coins deposited in basket 30 move downwardly through a chute (not shown) at the lower end of the basket and through an aperture 64 in the coin sorting mechanism mounting flange 42 and slide down the platform 46 of slide assembly 44. Parallel, longitudinally extending grooves 66 along the lower side and in the upper surface of the platform (see FIG. 5) reduce surface tension, especially when platform 46 is wet. This permits the coins (several of which are shown in phantom lines) to slide freely down the platform even under adverse conditions. Air can be blown through apertures 68 formed through the platform and shown in the same Figure to dry it, as necessary.

Figures 3, 4, 8:
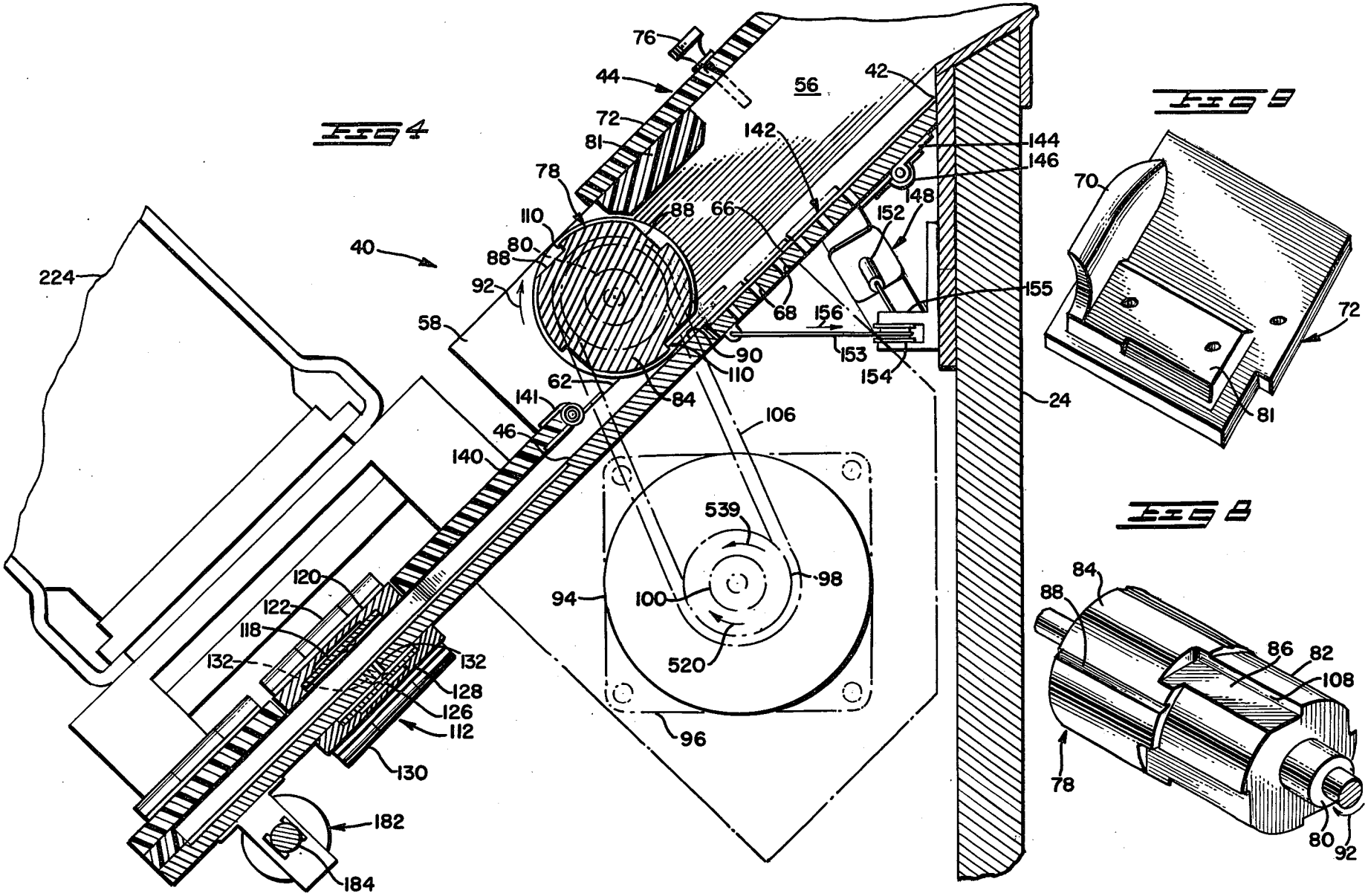
FIG. 4 is a section through the coin separator unit taken substantially along line 4—4 of FIG. 3.
FIG. 8 is a perspective view of a coin separator cylinder incorporated in the unit of FIG. 3.
Figure 5:
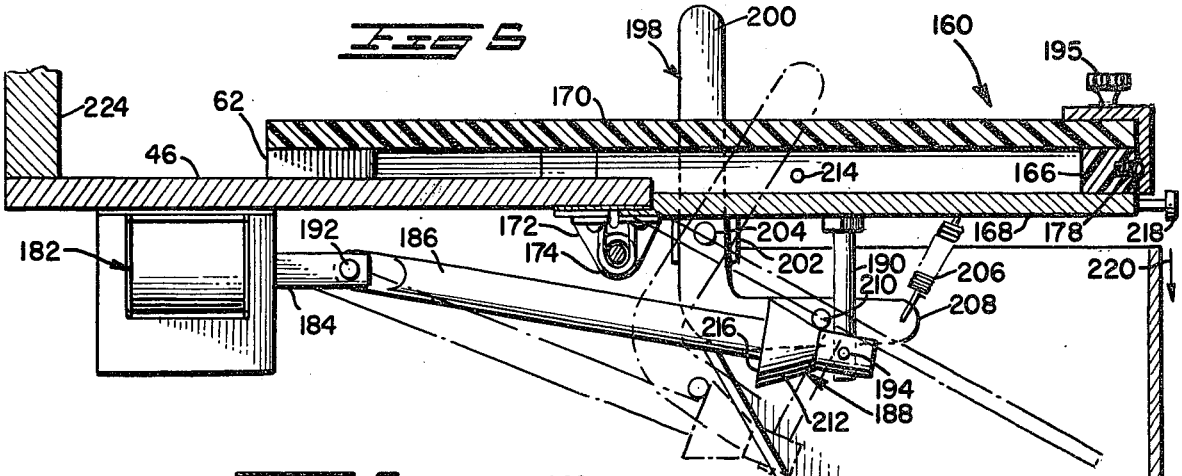
FIG. 5 is a view of the coin separator unit taken substantially along line 5—5 of FIG. 3 with certain of the components of that unit being shown in section to better illustrate their construction and relationship.

Referring now especially to FIGS. 3–5, proper operation of coin separator mechanism 40 requires that the coins being processed slide rather than roll down platform 46. Any coins which might roll onto the platform are knocked flat by a coin baffle 70, best shown in FIG. 9. Coin baffle 70 is supported adjacent the slide assembly side wall members 48 and 50 at the lower, right-hand side of the assembly by a removable cover plate 72. The latter is preferably fabricated from stainless steel; and it is removably fixed to the slide assembly side wall members 48 and 50 as by fasteners 74 and 76.

Coin baffle 70 tapers in a smooth curve to a sharp leading edge and to a sharp lower edge. Rolling coins engaging the baffle will accordingly be tipped onto a face and then slide down the platform 46 of the coin slide mechanism.

At the rear, or downhill, end of coin baffle 70 is a coin separator cylinder 78. It is a function of this component to align the coins dropping onto platform 46 into a single file as they slide down the platform and to guide them toward and against the rail 60 at the lower, right-hand side of the platform.

Separator cylinder 78 is mounted on a shaft 80. The latter is rotatably supported from slide assembly side walls 48 and 50 in appropriate bearings (not shown).

Referring now in particular to FIGS. 3 and 9, separator cylinder 78 transversely spans the space between slide assembly side wall 48 and guide rail 60 at its lower, right-hand end and side wall 50 and guide rail 62 at its upper, left-hand end.

A block 81 attached to the bottom side of cover 72 keeps coins from riding over the separator as they move down platform 46 toward it.

More or less mid way between its ends, separator cylinder 78 is divided into a right-hand section 82 of smaller diameter and a left-hand end section 84 of larger diameter. Longitudinally extending, equiangularly spaced flats 86 and 88 are milled into these respective portions of the cylinder.

Separator cylinder 78 is so supported above the platform 46 of coin slide assembly 44 that, with a flat 86 parallel to platform 46 (i.e., with the maximum gap between the platform and the cylinder), the thickest coin to be counted can slide therebetween. The cylinder is dimensioned, and the flats so milled, however, that the thinnest of the coins being counted cannot pass through the gap (identified by reference character 90 in FIG. 5) one atop the other.

Also, the smaller diameter portion of the separator cylinder is dimensioned longitudinally to accept the largest diameter coin being processed but is short enough to keep two of the smallest diameter coins from passing through gap 90 side by side.

In operation, separator cylinder 78 is rotated in the direction indicated by arrow 92 in FIG. 4 at a speed of 300–600 rpm by an electric motor 94. This motor is supported by a platelike bracket 96 from the platform 46 of coin slide assembly 44.

The drive connection between motor 94 and separator cylinder 78 includes a pulley 98 on motor output shaft 100, a pulley 102 on separator cylinder support shaft 80, and a flexible drive belt 106 extending between and trained around the pulleys.

With separator cylinder 78 rotating in the direction indicated by arrow 92 and at the speed identified above, a single coin appearing at the right-hand, smaller diameter part of the cylinder can slide through the gap 90 between it and slide assembly platform 46 and on down the platform adjacent guide rail 60. Coins appearing at the larger diameter, left-hand side of the cylinder will be deflected by it toward the lower side of platform 46 and will also slide along it through gap 90.

A coin piled atop another will be engaged by one of the longitudinally extending, radially oriented ledges 108 or 110 at the leading edge of a flat 86 or 88 and kicked back toward the upper end of slide assembly platform 46, thereby ensuring that the wanted single file movement of the coins down platform 46 along lower guide rail 60 is obtained. The flats 88 in the larger diameter part of the separator also kick away from that part of the cylinder single coins which might otherwise come to rest against it.

Figure 7:
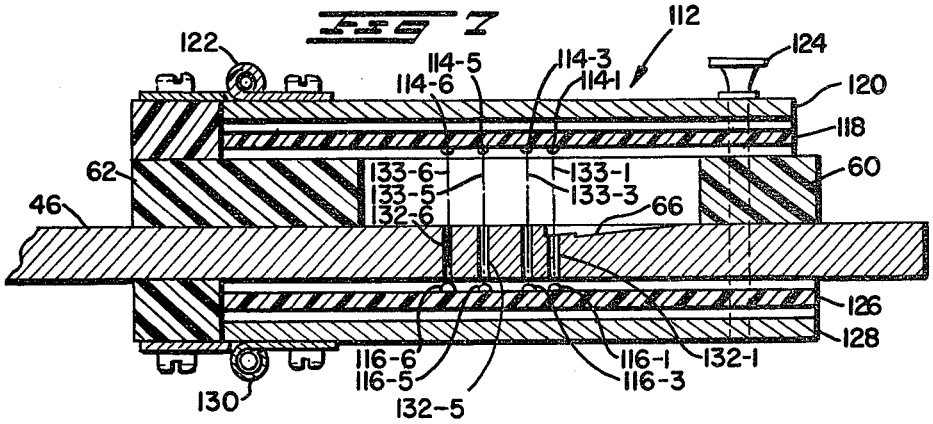
FIG. 7 is a section through the coin separator unit taken substantially along line 7—7 of FIG. 6.

As the coins thus move along the platform, their denominations are identified by a detection system best illustrated in FIGS. 7 and 8 and identified by reference character 112.

Coin denomination identification system 112 includes a series of LEDs or other light sources 114 and a corresponding, cooperating series of phototransistor (or other) detectors 116.

The LEDs are mounted on a circuit board 118. The latter is supported in spaced relationship above platform 46 by a platelike support and cover 120. The support is fixed by hinge 122 to the guide rail 62 toward the lower end and upper left-hand side of platform 46. This furnishes access to circuit board 118 and the LEDs for maintenance, etc. A threaded fastener 124 is employed to lock the circuit board support in the operating position shown in FIG. 7.

The detectors are similarly mounted on a circuit board 126 carried on a support cover 128. The latter is fixed by hinge 130 to the bottom of coin slide assembly platform 46, thereby furnishing access to the detector circuit board. Threaded fastener 124 also locks cover 128 in the normal operating position shown in FIG. 7.

Figure 6:
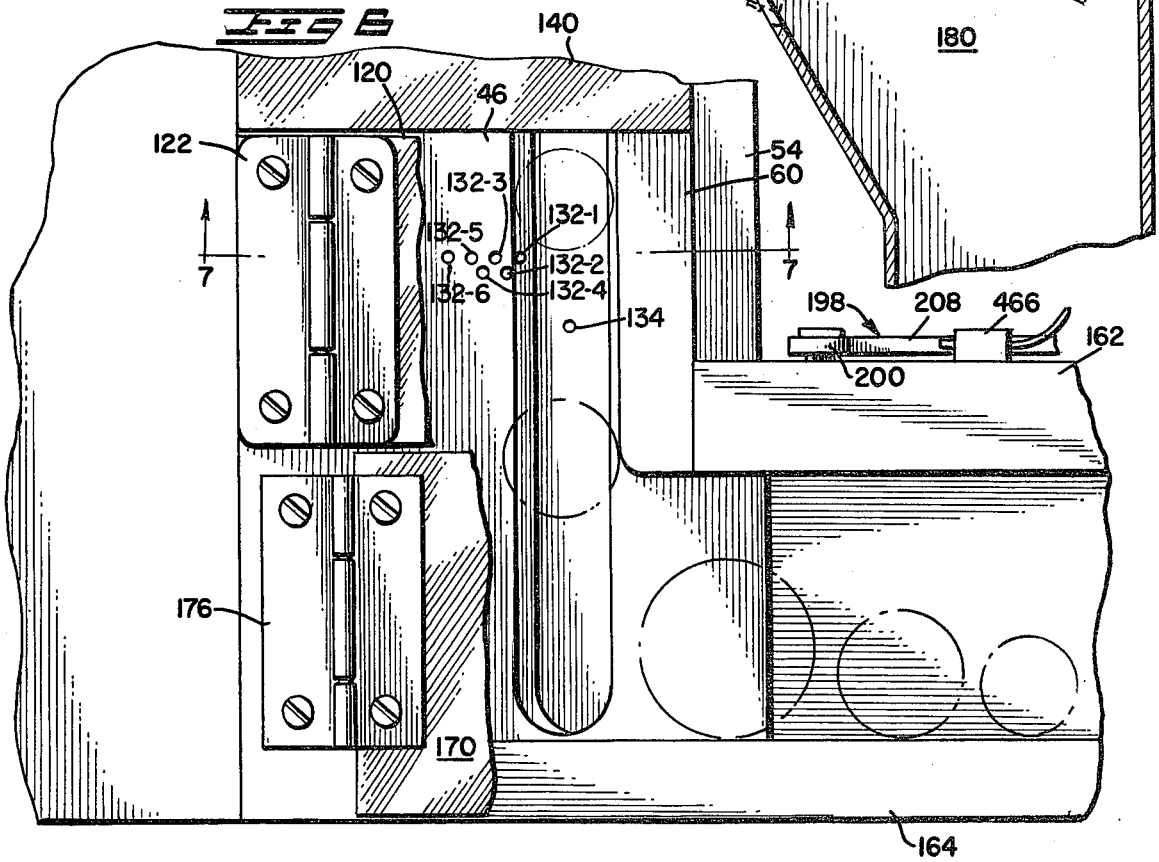
FIG. 6 is a plan view of that part of the coin separator unit shown in FIG. 5.

As best shown in the same Figure and in FIG. 6, the LEDs 114 and associated phototransistor detectors 116 are axially aligned with apertures 132 through the platform 46 of slide assembly 44. This furnishes an optical path 133 between each LED 114 and the associated detector.

The particular arrangement illustrated in FIGS. 6 and 7 is designed to accommodate the full complement of U.S. coins: penny, dime, nickel, quarter, dollar, and half dollar. Beginning from right to left in FIG. 7, aperture 132 are so spaced from the lower, right-hand guide rail 60 that successive ones of the apertures are covered by different ones of the foregoing coins sliding down platform 46 against rail 60 in the order just listed. That is, a dime sliding down the platform will cover aperture 132-1, while a penny will cover both that aperture and aperture 132-2, etc. Consequently, each coin of different denomination will interrrupt a pattern of optical paths which is peculiar to that denomination as it slides down platform 46. This results in the array of phototransistors 116 generating a unique signal for each denomination of coin as will be discussed in more detail hereinafter.

Spaced toward the lower end of coin slide assembly 44 from LEDs 114 and phototransistors 116; axially aligned with an aperture 134 through platform 46; and mounted on circuit boards 118 and 126, respectively, are an LED 136 and a cooperating, phototransistor detector 138. Aperture 134 is spaced close enough to guide rail 60 that will be covered by a coin sliding down platform 46 past the array of apertures 132 irrespective of the coin's denomination. This interrupts the optical path between LED 136 and detector 138 and generates a gating signal. That signal allows the coin denomination indicative signal generated by the array of phototransistors 116 to be transmitted to the circuitry by which it is processed.

The area of coin slide assembly 44 between separator cylinder 78 and the upper circuit board support cover 120 is spanned by a preferably transparent cover 140 which rests on guide rails 60 and 62 and is supported from them by a spring loaded piano hinge 141. That spring biases the cover to the closed position shown in FIG. 3. Cover 140 can accordingly be readily opened in the event this becomes necessary for maintenance or other purposes.

As best shown in FIG. 5, a downwardly opening trapdoor 142 is formed in platform 46 immediately adjacent, and on the upstream side of, separator cylinder 78. Trapdoor 142 is supported from platform 46 by a transversely extending, piano-type hinge 144; and it is biased to the illustrated, closed, position by a spirally wound spring 146.

Trapdoor 142 is a scavenge dump. It can be opened to dump slugs, washers, and other foreign objects rejected by separator cylinder 78 from slide assembly platform 46.

The trapdoor is opened by energizing a solenoid 148 (see FIGS. 3 and 5) which is supported from slide assembly platform 46 by bracket 150.

The armature 152 of the solenoid is connected by a flexible cable 153 to that lower edge of trapdoor 142 opposite hinge 144. As best shown in FIG. 5, this cable is trained around a pulley 154 supported by bracket 155 from the mounting flange 42 of coin separation and identification unit 40.

Energization of solenoid 148 results in retraction of armature 152 and movement of cable 153 in the direction indicated by arrow 156 in FIG. 5. This swings trapdoor 142 down and open against the bias exerted by spring 146; and objects on platform 46 drop through it.

Deenergization of the solenoid following the dumping of foreign objects from platform 46 allows spring 146 to return the trapdoor to the illustrated, closed position.

Referring now in particular to FIGS. 3 and 5–7, coins identified by the detection system 112 just described slide from platform 46 of the coin slide assembly into an escrow display 160. This unit, which is oriented at a right angle to platform 46, extends downwardly and to the right from the lower end of the platform.

The escrow display has upper and lower side members or guides 162 and 164, an end wall 166 at its lower end, a second trapdoor 168, and a preferably transparent top cover 170.

The end wall 166 of the escrow display is fastened to side walls or rails 162 and 164 which, in turn, are mounted on coin slide assembly platform 46.

Trapdoor 168 is supported from component 46 by a hinge 172 (see FIG. 6); and it is biased to the illustrated, closed position by a coil spring 174.

Top cover 170 is supported from platform 46 by a hinge 176 (see FIG. 3), and is normally locked in the closed position shown in that Figure by a conventional, spring loaded fastener 178.

Trapdoor 168 is opened to drop coins from escrow display 160 through a chute 180 into coin vault 32 by energizing a solenoid 182. That solenoid is mounted on the bottom side of coin slide assembly platform 46.

As best shown in FIG. 6, the armature 184 of the solenoid is coupled through a connecting rod 186, a fitting 188, and a coupler 190 to trapdoor 168. The connecting rod is pivotally fastened to armature 184 by a pivot pin 192 through the left-hand end of the connecting rod and to coupler 190 by a pivot pin 194 through fitting 188.

Energization of solenoid 182 results in retraction of its armature 184. This displaces the connecting rod 186 and trapdoor coupler 190 to the positions shown in phantom lines in FIG. 6, thereby opening the trapdoor as shown in the same manner in that Figure. Subsequent deenergization of the solenoid allows spring 174 to return the trapdoor to the closed position.

The cover 170 of escrow display 160 may be opened by pulling upward on pull 195 and pivoting the cover upwardly. This allows evidence of toll violations such as an insufficient number of coins or slugs to be removed from the escrow display for use as evidence, for example.

Cover 170 also supports a triangular guide 196 which guides coins from slide assembly platform 46 into the escrow display.

Referring now most particularly to FIG. 6 it is advantageous to be able to disable the escrow display and to instead allow coins to drop directly into coin vault chute 180 when they reach the lower end of slide assembly platform 46. A crank 198 with a manually manipulatable handle 200 is provided for that purpose.

Crank 198 is pivotally supported from the upper, escrow display side rail 162 by a bracket 202 and a pivot pin 204. Crank 198 is biased to the position illustrated in full lines in FIG. 6 by a tension spring 206 extending between, and connected to, the lower arm 208 of the crank and rail 162.

Mounted on lower crank arm 208 and extending transversely therefrom is a pinlike actuator 210. As crank 198 is rotated in a clockwise direction by handle 200 from the position shown in full lines in FIG. 6 to the position in phantom lines in the same Figure, actuator 210 engages, and slides along, the inclined surface 212 of the fitting 188 at the right-hand end of connecting rod 186. This depresses the fitting, shifting it and the connecting rod to the same phantom line position to which they are moved by energization of solenoid 182. This pivots trapdoor 168 to its open position.

As the clockwise rotation of crank 198 is continued, actuator 210 rides off the trailing edge of inclined surface 212. Concurrently, handle 200 reaches, and is halted, by a stop 214 fixed to upper, escrow display side rail 162. This movement allows trapdoor biasing spring 174 to restore connecting rod 186 and fitting 188 toward the closed position until the right-hand end of the connecting rod engages crank mounted actuator 210. As shown in phantom lines in FIG. 6, this locks actuator 210 against the rear or trailing side 216 of fitting 188. That prevents crank 198 from rotating back to its normal, full line position and keeps the connecting rod and fitting from returning to their full line positions, thereby locking trapdoor 168 open.

To subsequently restore trapdoor 168 to the closed position, an operator 218 fixed to that end of the trapdoor opposite hinge 172 is displaced in the direction indicated by arrow 220 in FIG. 6. This moves fitting 188 out of contact with crank mounted actuator 210, allowing spring 206 to return the crank and actuator to the full line positions. Upon release of actuator 218, biasing spring 174 restores the trapdoor to the closed position.

As will be apparent to the reader from the foregoing, a number of electrical connections must be made to the coin separation and denomination detecting unit 40 of system 22. These are effected by plug-in connectors (not shown) supported by a bracket 224 from slide assembly platform 46 and by a third plug-in connector (likewise not shown) mounted directly on that component.

Figure 10:
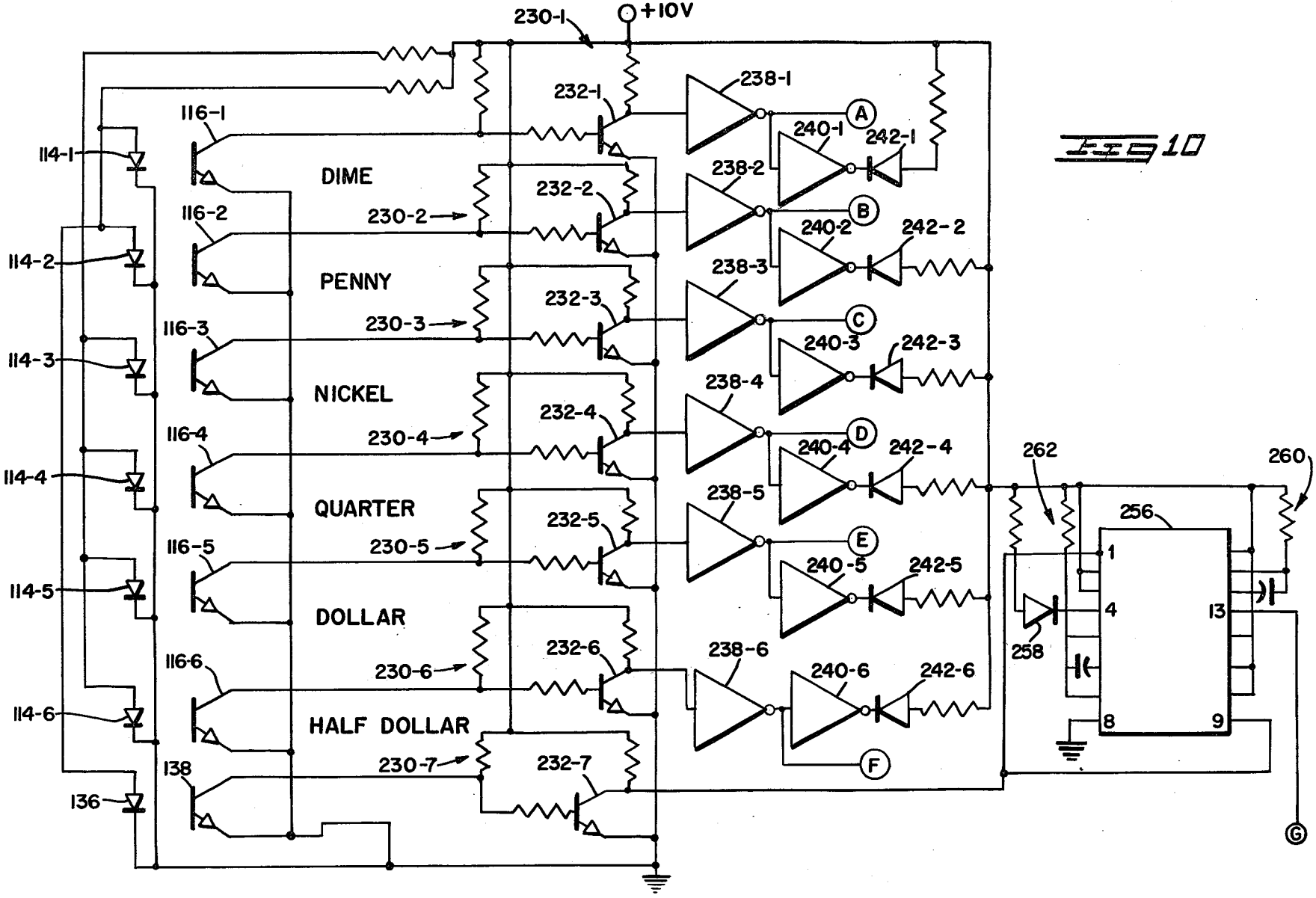
FIG. 10 is a schematic of coin denomination detecting circuitry incorporated in the coin collection and counting system.

As indicated above, system 22 also includes circuitry in which LEDs 114 and phototransistors 116 are incorporated for generating signals indicative of the denominations of coins moving past detection system 112 and for generating a gating signal which allows the denomination indicative signals to be transmitted to circuitry in which the value of the coins deposited in basket 30 is ascertained and the other, above-discussed functions carried out by system 22 thereby initiated. The circuitry for generating coin denomination indicative signals and the gating signal is illustrated in FIG. 10 to which the reader is now referred.

As discussed above, the movement of a coin down coin slide assembly platform 46 past coin identification system 112 results in the generation of an electrical signal which is unique to the denomination of the coin. This is because a different pattern of apertures in platform 46 is covered by each denomination of coin as the coin slides past the coin identification system, thereby interrupting a combination of the optical paths 133 between LEDs 114-1–114-6 and detectors 116-1–116-6 which is different for each denomination of coin.

The exemplary coin collection and counting system illustrated in the drawing is designed to process pennies, nickels, dimes, quarters, half dollars, and dollars. The optical paths 133 between the LEDs 114 and the associated detectors 116 that are interrupted by each of these coins as the coins slide down platform 46 of coin slide assembly 44 appear in the following truth table:

TABLE 1

| | | Optical Path 133 Interrupted | | | | | |
|---|---|---|---|---|---|---|---|
| Denomination | LED To Detector | 114-1 to 116-1 | 114-2 to 116-2 | 114-3 to 116-3 | 114-4 to 116-4 | 114-5 to 116-5 | 114-6 to 116-6 |
| Dime | | Yes | No | No | No | No | No |
| Penny | | Yes | Yes | No | No | No | No |
| Nickel | | Yes | Yes | Yes | No | No | No |
| Quarter | | Yes | Yes | Yes | Yes | No | No |
| Half Dollar | | Yes | Yes | Yes | Yes | Yes | Yes |
| Dollar | | Yes | Yes | Yes | Yes | Yes | No |

The coin denomination detecting circuitry associated with the LEDs includes an amplifier 230-1–230-6 paired with each of the six detectors 116 and a seventh amplifier 230-7 paired with the gating signal detector 138 referred to above. The active devices of amplifiers 230-1–230-7 are transistors 232-1–232-7.

The output sides of the amplifiers 230-1–230-6 are connected to serially wired inverters 238-1–238-6 and 240-1–240-6. These components provide the correct operating voltage to LEDs 242-1–242-6 and to NAND gates 244-1–244-5 (see FIG. 11).

The operation of the circuitry thus far described and certain other circuitry associated therewith can best be understood by way of example. It will accordingly be assumed that the toll to be collected at toll station 20 is $1.95; that the patron deposits this toll in the form of a dollar, one half dollar, one quarter, one dime, one nickel, and five pennies; and that those coins slide down the platform 46 of coin slide assembly 44 in the following order—dime, penny, penny, quarter, penny, nickel, penny, penny, dime (the sequence has no bearing on the operation of the coin collection and counting system 22 or the results that are produced).

Referring now specifically to FIG. 10, the passage of the first coin identified above; viz., the dime, down the platform 46 of coin slide assembly 44 blocks the optical path 133-1 between LED 114-1 and detector 116-1 as indicated by Table 1 above. Detector 116-1 consequently ceases to conduct. The base of amplifier transistor 232-1 is thereby forced positive, causing the transistor to conduct. This causes the input of inverter 238-1 to go low, its output and Ⓐ to go high, and the input to inverter 240-1 to go high. The output of inverter 240-1 consequentially goes low, energizing LED 242-1 and thereby indicating that the just-described coin detecting and amplifying circuit is operating properly.

As will become apparent hereinafter, this use of an LED to indicate whether a circuit is functioning properly is employed in association with the critical circuits of the exemplary coin collection and counting system disclosed herein. This is an important feature of my invention, from the practical viewpoint, as it permits inexperienced personnel to determine whether the system is functioning properly and, if a failure occurs, to ascertain where it is.

Referring again to the drawing, the continued movement of the dime down platform 46 will result in its interrupting the optical path between LED 136 and gate pulse generating detector 138 over a time period at least partly coinciding with that during which the path between LED 114-1 and detector 116-1 remains blocked.

Detector 138 accordingly ceases to conduct. In a manner akin to that described above, this causes the transistor 232-7 of amplifier 230-7 to conduct, putting lows on inputs 1 and 9 of a dual one-shot 256. The low on input 1 causes a pulse to appear at terminal 13 of the one-shot and, consequently, at Ⓖ in FIG. 1.

At the same time, a circuit between terminals 4 and 8 of the one-shot is completed. This energizes an LED 258, thereby providing an indication that the gate pulse generating circuitry just described is operating correctly.

Associated with one-shot 256 are two timing circuits 260 and 262. The first of these circuits determines the duration of the gating pulse or signal appearing at Ⓖ. The second determines the length of time for which LED 258 remains energized.

Figure 11:
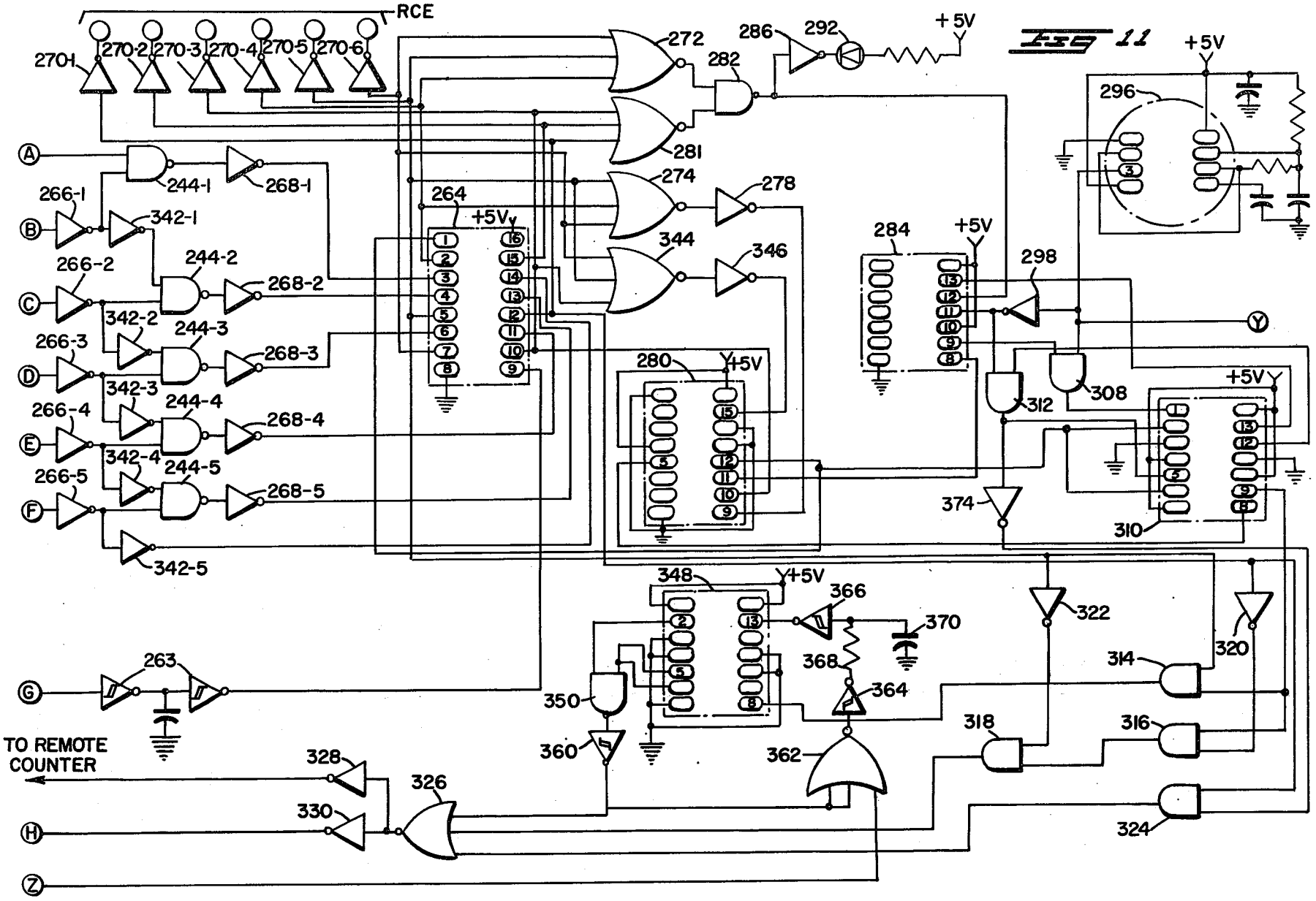
FIG. 11 is a schematic of counting circuitry incorporated in the coin collection and counting system.

Referring now to some extent to FIG. 10, but primarily to FIG. 11, the high appearing at Ⓐ (FIGS. 10 and 11) causes input 1 of NAND gate 244-1 to go high.

The high appearing at Ⓖ is applied to the input of a two-stage Schmitt trigger 263 which has an output connected to terminal 9 of a Hex-D flip flop 264 ("D" is used herein to identify flip flops which are triggered by the leading edge of a pulse). The Schmitt trigger shapes the pulse in a manner that reduces the chances of the flip flop being triggered by noise.

The use of a Schmitt trigger in the manner just described; i.e., to isolate flip flop 264 from one-shot 256, the use of previously described inverters 238-1 and 240-1 to isolate LED 242-1 and gate 244-1 from amplifier 230-1, and the use of the inverters and Schmitt triggers to be described hereinafter for comparable isolation purposes is also deemed an important feature of my invention because of the considerable amounts of electrical noise that typically exist at a toll collection station. It is to be understood in this regard, however, that it is the isolation of the circuitry, as such, which is of primary importance, and not the manner in which the isolation is effected, as there are other circuit arrangements which could equally well be employed for this purpose.

Referring again to FIGS. 10 and 11, it will be apparent from the operation of the electronic components of system 22 thus far described that, of the coin denomination related detectors 116 and transistors 232, only detectors 116-1 and transistor 232-1 are made respectively non-conductive and conductive by the passage of a dime down platform 46. Consequently, at the time the high described above is applied to NAND gate 244-1, lows appear at Ⓑ through Ⓕ (FIGS. 10 and 11). A low at Ⓑ and, consequently, at the input to inverter 266-1 (FIG. 11) causes the output of the inverter to remain high, placing a high on input 2 of NAND gate 244-1. As input 1 of the gate is held high by virtue of the dime blocking the optical path between LED 114-1 and detector 116-1, the output of the NAND gate goes low, inverter 268-1 goes high, and a high is consequently placed on terminal 3 of flip flop 264.

With the high applied as just described to terminal 3 of Hex-D flip flip 264, the application of the gate pulse to terminal 9 from Schmitt trigger 263 causes output 2 of the flip flop to go high. This high appears at inverter 270-2, driving the inverter low. That produces one "dime pulse" for remote counting equipment which is not shown in detail in FIG. 11 but is identified as "RCE". As pulse actuated counters are widely available, it is not deemed necessary to either describe or illustrate the remote counters herein.

Referring back to FIG. 11, the pulse or high appearing at terminal 2 of Hex-D flip flop 264 also appears at input 1 of NOR gate 272 and at input 10 of NOR gate 274. With only transistor 232-1 of those associated with the coin denomination related circuits conducting, the outputs 5 and 7 of Hex-D flip flop 264 remain low as do the corresponding terminals of NOR gate 272 and NOR gate 274. Consequently, the outputs of both NOR gates 272 and 274 are low.

The low at the output of NOR gate 274 causes inverter 278 to go high, putting a high on the 9 or dime input of, and conditioning, a presettable, binary coded decimal counter 280 to receive a count.

Also, with a dime blocking the optical bath between LED 114-1 and detector 116-1 and only transistor 232-1 of those relating to the coin denomination identifying circuitry conducting, the output of the NOR gate 281 shown in FIG. 11 will be high because all of the flip flop terminals connected to that gate are untriggered and remain low. Consequently, at the same time that input 9 of counter 280 goes high, a high and a low are put on the inputs of NAND gate 282, driving its output high. A high accordingly appears on the 12 or "D" input of a dual flip flop 284.

At the same time that the high is placed on input 12 of flip flop 284, the high appears at the input of inverter 286, driving it low and energizing LED 292. This indicates that the proper coin count has been stored in decade counter 280 and that flip flop 284 has been triggered.

Associated with flip flop 284 is a continuously oscillating clock 296. The first transition of the clock output from positive to negative after the high appears at input 12 of flip flop 284 drives inverter 298 high. This places a high on terminal 11 of flip flop 284, causing the flop flop to change states with terminal 9 going high and terminal 8 going low. The low at terminal 8 is applied to terminal 11 of decade counter 280, presetting that counter with a count of 8.

The high at terminal 9 is applied to one input of AND gate 308. The next positive pulse from clock 296, appearing at terminal 3, is applied to the second input of AND gate 308, causing the output of the AND gate to go high and applying a high at the clock input 1 of a J-K flip flop 310.

The next negative pulse from the clock causes flip flop 310 to change states with terminal 12 going high and terminal 13 going low. The low is applied to the "clear" input 13 of flip flop 284, causing the latter to change states and revert to a clear condition. This readies it for the next counting operation.

The high at terminal 12 of flip flop 310 is applied to one input of AND gate 312. The other input of that gate is connected through inverter 298 to output terminal 3 of the clock 296. Consequently, every transition at clock terminal 3 from postive to negative drives the inverter high and causes a high to be produced at the output of AND gate 312 while every transition at clock terminal 3 from negative to positive causes a low to appear at the output of the AND gate.

The AND gate output pulses generated when it goes high appear at clock input 5 of dual flip flop 310, causing the flip flop to act as a divide-by-two counter and cut the clock frequency by half.

The resulting, lower frequency pulses are applied from terminal 8 of dual flip flop 310 to the "count-up" input 5 of decade counter 280. They are also placed from output 9 of the flip flop on one input of AND gate 314 and one input of AND gate 316.

As this occurs, the second input of gate 316 and one input of AND gate 318 are high. This is because gates 316 and 318 are connected through inverters 320 and 322 to the dollar and penny outputs 12 and 5 of Hex-D flip flop 264 and because, as discussed above, those outputs remain low while a dime is being counted inasmuch as the dollar and penny associated amplifier circuits are nonconducting. That drives the inverter high.

The result is that the output of AND gate 316 becomes high. This output is applied to AND gate 318, and the latter accordingly also becomes high. The outputs of AND gate 314 and a fourth AND gate 324, on the other hand, remain low.

The high from AND gate 318 is applied to the input side of NOR gate 326. Consequently, the high at the output of gate 318 appears at one input of NOR gate 326, the low at gate 324 appears at the other NOR gate input, and a low appears at the output of that gate.

Conversely, when the signal at output 9 of flip flop 310 goes low, one of the two inputs to AND gate 316 remains low. The output of that gate accordingly remains low as does the associated input to AND gate 318 and its output. In this case lows are applied at both of the aforementioned inputs to NOR gate 326, and its output accordingly goes high.

The net consequence of this is that, as outputs 8 and 9 of flip flop 310 alternate states, two series of pulses are produced with a phase difference of 180°.

The series of pulses produced by output 9 of flip flop 310 is directed through AND gates 316 and 318 to NOR gate 326 and parallel inverters 326 and 328 and from gate 326 and counter 332 (see FIG. 12A). Due to the double inversion of the signal caused by NOR gate 326 and inverter 330 the pulse on input 5 of counter 332 is still 180° out of phase with the pulse from output 8 of flip flop 310.

This pulse from output 8 is applied directly to input 5 of counter 280. As the count input on the two counters is out of phase, counter 332 is incremented one half clock cycle ahead of counter 280. Counter 332, and a second decade counter 334 (illustrated in FIG. 12A), accumulate pulses representative of the total value of the coins that have been identified by coin detection system 112. Decade counter 332 accumulates counts or pulses representing from 1 to 10 nickels. Every tenth pulse is transferred to decade counter 334 which consequently counts ten to 100 nickels in increments of 10.

Referring now back to FIG. 11, it will be remembered that the passage of a dime through coin denomination detection system 112 results in a count of 8 being loaded into presettable decade counter 280. After the second count pulse has been generated in the manner discussed above and applied to the "count up" input of 5 of the decade counter—which also results in two pulses being applied to terminal 5, and to, and accumulated in, decade counter 332—a count of ten will be reached in decade counter 280. This fills that counter, causing a "carry output" to be generated at terminal 12. This pulse is applied to the reset input 1 of Hex-D flip flop 264 and to inputs 2 and 6 of dual flip flop 310.

This returns all circuits and circuit components to their original states; i.e., to those existing at the time that the counting operation of the dime discussed above was initiated.

The generation of a reset pulse, because it causes a low to appear at output 9 of flip flop 310, also causes the associated input of AND gate 316 to go low. The output of that gate accordingly goes low as does the associated input and the output of AND gate 318. This, in turn, causes the output of NOR gate 326 to go high and the output of inverter 330, applied to decade counter 332, to become low. With the two pulses representing two nickels—i.e., one dime—stored in that counter, a high appears at its terminal 2 driving inverter 335-2 low and thereby energizing an LED 336-2 (see FIG. 12A).

This LED is one of two series of four identified by numerical prefixes 336 and 338. LEDs 336-1, 336-2, 336-3, and 336-4 respectively indicate that 1, 2, 4, and 8 nickel representing pulses have been stored in decade counter 332. Similarly, LEDs 338-1, 338-2, 338-3, and 338-4 indicate that 1, 2, 4, and 8 pulses respectively indicative of 10, 20, 40, and 80 nickels have been stored in decade counter 334.

These novel, binary coded decimal, visual displays are, again, provided for checking the operation of system 22 and for maintenance purposes.

In the example on which the foregoing and continuing discussion of my invention is based, the depositing of the $1.95 (39 nickels) should result in LEDs 338-2 (20 nickels), 338-1 (ten nickels) 336-4 (8 nickels), and 336-1 (one nickel) then being lit. Consequently, by ascertaining that this is the case, operating or maintenance personnel can easily, and visually, verify that the coin identification and counting circuitry is performing satisfactorily.

The two displays 336 and 338 of LEDs can also be used for in-process-of-counting maintenance checks. Specifically, by comparing the value of the coins in escrow display 160 with the value indicated to have been counted by the LEDs in displays 336 and 338, operating and maintenance personnel can, again, visually verify that the system is operating properly.

Referring now back to FIG. 10, it will be remembered that the next coin to slide down platform 46 of coin slide assembly 44 is a penny.

When it reaches coin denomination detection system 112, the penny interrupts the optical path between LED 114-2 and detector 116-2 as well as the optical path 133-1 between LED 114-1 and detector 116-1.

With these detectors optically cut off from the associated LEDs, transistors 232-1 and 232-2 conduct. LED 242-1 will consequently be energized in the manner discussed above, and a high will appear at Ⓐ. Also, inverters 238-2 and 240-2 will go high and low, respectively, causing a high to appear at Ⓑ and energizing LED 242-2.

Referring now to FIG. 11, the high at A is applied to one input of NAND gate 244-1. The high at Ⓑ is applied to inverter 266-1, driving its output low and thereby applying a low to NAND gate 244-1. The output from this gate accordingly remains high, and the output from inverter 268-1 remains low and incapable of triggering Hex-D flip flop 264.

However, the low appearing at the output of inverter 266-1 is also applied to inverter 342-1, driving it high and applying a high to one input of NAND gate 244-2. Because the remaining coil denomination associated detectors 116-3–116-6 are not involved in the penny counting sequence, a low appears at Ⓒ (see FIGS. 10 and 11); and the output of inverter 266-2 is high, placing a high on the second input to NAND gate 244-2. the gate output accordingly goes low; and the output of inverter 268-2 goes high, applying a high to terminal 4 of flip flop 264.

With a high placed as just described on input 4 of flip flop 264, the application of the gate pulse to input 9 of the flip flop in the manner described above causes output 5 to go high. This drives inverter 270-5 low, producing one "penny pulse" for remote counting equipment RCE.

The high appearing at output 5 also appears at one input of NOR gate 274, on one input of NOR gate 272, and on one input of a fourth NOR gate 344.

The outputs of NOR gate 274 and NOR gate 344 go low because the remaining inputs are all connected to flip flop outputs which are not triggered when a penny is being counted and are therefore low. Inverters 278 and 346 are consequentially driven high; and highs consequently appear at inputs 9 and 15 of resettable counter 280, presetting a count of 9 in that counter.

The application of the high to NOR gate 272 causes it to go low because its remaining inputs are connected to untriggered, "low" terminals of flip flop 264. This initiates the sequence of events described above in conjuction with the counting of a dime. That is, LED 292 is energized, indicating that the proper coin count has been stored in decade counter 280 and that the "count up" sequence or incrementing of the counter has been initiated.

The incrementing of decade counter 280 is also carried out in the manner described above except that the circuits are reset after the counter has been incremented one time.

In addition, in the case of a penny, the count is stored in a decade counter 348 (see FIG. 11) rather than in the decade counter 332 discussed above. More particularly, the high appearing at output 5 of Hex-D flip flop 264 is applied to one input of AND gate 314 as well as the input of inverter 322. When the clock pulse drives output 9 of flip flop 310 high, the output of both AND gates 314 and 316 will go high. The high on AND gate 314 is applied to the clock input of counter 348, incrementing it by one count. The high on inverter 320 causes one input of AND gate 318 to go low, preventing the high on AND gate 316 from reaching the NOR gate 326. This prevents the penny count from incrementing counter 332.

It will be recalled that the third coin to slide down platform 46 of coin slide assembly 44 is also a penny.

This penny is identified and counted in the manner just described with decade counter 348 now containing a count of two.

The fourth coin to be counted is a quarter. At coin identification system 112, it interrupts the optical paths 133 between LEDs 114-1, 114-2, 114-3, and 114-4 and the associated detectors 116-1, 116-2, 116-3, and 116-4, making the transistors 232-1, 232-2, 232-3, and 232-4 conductive. This causes LEDs 242-1 and 242-2 to be energized and highs to appear at Ⓐ and Ⓑ as discussed above.

Also, inverters 238-3 and 238-4 are driven high, and inverters 240-3 and 240-4 are driven low. This causes highs to appear at Ⓒ and Ⓓ and energizes LEDs 242-3 and 242-4.

Referring now to FIG. 11, the highs at Ⓐ, Ⓑ, Ⓒ, and Ⓓ cause inverters 266-1, 266-2, and 266-3 to go low, driving inverters 342-1, 342-2, and 342-3 high. A high and a low are consequently applied to gate 244-1, and its output remains high.

The same is true of gate 244-2 which receives a high from inverter 342-1 and a low fron inverter 266-2 and of gate 244-3 which receives a high from inverter 342-2 and a low from inverter 266-3.

However, highs are applied to both inputs of gate 244-4. The first is from inverter 342-3 which is driven high by the low at the output of inverter 266-3. And, because transistor 232-5 (see FIG. 10) does not conduct in this counting sequence, a low appears at Ⓕ and the input side of inverter 266-4, driving it high and applying a high to the second input of gate 244-4.

With a high on both inputs, the output of NAND gate 244-4 goes low, driving the output of inverter 268-4 high and applying a high to terminal 11 of Hex-D flip flop 264.

The quarter next triggers the gate circuit, applying a gate pulse to input 9 of flip flop 264 in the manner described above. This causes terminal 10 of the flip flop to go high, making a "quarter" pulse available to the remote counting equipment through inverter 270-3. Highs are also applied from flip flop terminal 10 to one input of NOR gate 281, to one input of NOR gate 344, and to terminal 10 of decade counter 280. Lows are placed on the other inputs to NOR gates 281 and 344 from flip flop 264, and the outputs from both gates are therefore low.

The low from NOR gate 344 drives inverter 346 high, applying a second high to input 15 of decade counter 280. The highs at inputs 10 and 15 preset the decade counter with a count of five.

The low from gate 281 also drives the output of NAND gate 282 high because all inputs to gate 272 are low, and its output is therefore high. As in the previously described counting operations, this causes LED 292 to be energized by driving the output of inverter 286 low. In addition, this initiates the generation of "count up" pulses and the transmitting of those pulses to decade counter 280.

Concurrently, five pulses are generated through inverter 328 to remote counting equipment.

As decade counter 280 is incremented through the five pulses needed to fill it, an equal number of pulses are accumulated in the decade counter 332 shown in FIG. 12A in the manner discussed above in conjuction with the identification and counting of a dime. That resulted in two pulses being stored in that counter. Consequently, when resettable counter 280 is filled and the reset signal generated, decade counter 332 will contain a count of seven.

With a count of seven stored in decade counter 332, highs appear at terminals 2, 3, and 6 of that counter, driving the corresponding inverters 335-1, 335-2, and 335-3 low and energizing LEDs 336-1, 336-2, and 336-3. An observer can thereby ascertain that the correct count ($1+2+4=7$) has been stored in the decade counter.

The next coin to be counted is also a penny. It is counted in the same manner as the two preceding pennies, and the circuit is similarly reset at the completion of the counting operation.

At this point the "penny" counter 348 contains a count of 3; and, as just discussed, decade counter 332 contains a count of seven.

The next coin to be counted in the example at hand is a nickel. In coin detection system 112, it blocks the optical paths 133 between LEDs 114-1, 114-2, and 114-3 and the corresponding detectors 116-1, 116-2, and 116-3 (see FIG. 3). Transistors 232-1, 232-2, and 232-3 accordingly conduct; LEDs 242-1, 242-2, and 242-3 are energized; and highs appear at Ⓐ, Ⓑ, and Ⓒ. This drives inverters 266-1 and 266-2 (see FIG. 11) low and inverters 342-1 and 342-2 high.

A high is consequently applied to NAND gate 244-1 from Ⓐ and a low from inverter 266-1 and the output of this gate therefore remains high.

The same is true of NAND gate 244-2 because a high is applied from inverter 342-1 and a low from inverter 266-2.

However, highs are applied to both inputs of NAND gate 244-3. One if from inverter 342-2. The other is applied from inverter 266-3 which is driven high because Ⓓ is low when a nickel is being counted.

With both inputs to NAND gate 244-3 high, the output is low, inverter 268-3 is driven high, and a high appears at terminal 6 of Hex-D flip flop 264.

The subsequent imposition of the gate pulse (again generated as described above) on terminal 9 of the flip flop triggers that component, causing a high to appear at terminal 7. That drives inverter 270-6 low, producing a "nickel" pulse for remote counting equipment RCE.

Also, highs are placed on NOR gates 272, 274 and 344. For reasons of the character discussed above, this drives the gate outputs low and the outputs of inverters 278 and 346 high, placing highs on inputs 15 and 9 of decade counter 280. As discussed above in conjuction with the counting of the first penny, this stores a count of 9 in the counter.

Because of the connections to untriggered terminals of flip flop 264, the high on gate 272 causes its output to go low and the output on gate 281 to remain high. A high and a low are accordingly applied to gate 282, causing its output to go high. Again, this energizes LED 292 and initiates the counting sequence.

With a count of 9 stored, one count fills resettable counter 280, a single nickel pulse consequently being applied to and stored in decade counter 332 (see FIG. 11). As in the previous operations, a reset pulse then appears at output 12 of counter 280; and the circuitry returns to its initial state.

At this point, a count of 3 is stored in penny counter 348 and a count of 8 in decade counter 332.

With a count of 8 stored, a high appears at terminal 7 of the decade counter, all other output terminals remaining or becoming low. Consequently, LEDs 336-1, 336-2, and 336-3 are deenergized; and inverter 335-4 is driven low. This energizes LED 336-4 which corresponds to a stored count of eight.

Also, as inverter 330 is driven low in the counting of the nickel, inverter 328 (see FIG. 11) is driven low in the manner discussed above, producing one actuating pulse for a remote counter.

The next two coins to be counted are also pennies. These are counted in exactly the same manner as the three previous pennies, and two counts are stored in penny counter 348.

The second of these counts is the fifth to be accumulated in counter 348. This causes a high on counter outputs 2 and 5 (Binary 1+4=5). This causes NAND gate 350 to go low and Schmitt trigger 360 to go high, putting a high on one input of NOR gate 326. This causes NOR gate 326 to go low. Inverter 330 consequently goes high, incrementing counter 332 by one. At the same time, inverter 328 goes high, producing a pulse for a remote counter (not shown).

The high on the output side of Schmitt trigger 360 is imposed on two inputs to NOR gate 362. The third input to NOR gate 362 is low at this junction. This causes the output of the gate to go low, driving Schmitt trigger 364 high and Schmitt trigger 366 low and thereby applying a reset signal to input 13 of counter 348.

The resistor 368 and capacitor 379 associated with Schmitt triggers 364 and 366 constitute a timing circuit. This circuit delays the imposition of the reset signal on the timer, thereby ensuring that a complete count or pulse is transmitted to decade counter 332 and to the remote counter on the output side of inverter 328.

At this juncture, counter 348 is empty; and a count of 9 is stored in counter 332. Consequently, highs appear on terminals 3 and 7 of the latter, resulting in LEDs 336-1 and 336-4 being energized to indicate that the correct count (1+8=9) has been stored in counter 332.

Referring back to FIG. 10, the next coin to be counted is a half dollar.

This coin blocks all of the optical paths 133 between the LEDs 114 and detectors 116. As a consequence, all six transistors 232 conduct, driving all six inverters 238 low and the six inverters 240 high. All six LEDs 242-1–242-6 are consequently energized, and highs appear at Ⓐ, Ⓑ, Ⓒ, Ⓓ, Ⓔ, and Ⓕ.

Referring then to FIG. 11, this results in inverters 266-1–266-5 being driven low and inverters 342-1–342-5 being driven high.

As will be apparent from the description of my invention thus far, this results in the outputs from NAND gates 244-1–244-5 remaining high. However, the low at the output of inverter 266-5 drives inverter 342-5 high, applying a high to input 14 of Hex-D flip flop 264.

Thereafter, the operation of the circuits are as described above except that a count is not loaded into resettable counter 280 before the incrementing of that counter is initiated.

This means that counter 280 must be incremented 10 times before the reset signal is generated.

Ten counts or pulses are accordingly transmitted to decade counter 332 (FIG. 11).

The first of these counts fills that counter. This produces a high or "carry output" at terminal 12 of counter 332. The carry output is applied to input 5 of decade counter 334, incrementing that counter by one count while clearing counter 332.

The remaining 9 pulses are accumulated in counter 332 in the manner discussed above.

As a consequence, at the end of the counting sequence when resettable counter 280 is filled and the reset pulse generated, decade counter 332 will contain 9 counts; and decade counter 334 will contain one count.

This is a total count of 19, indicating that coins totalling $0.95 have been counted.

At this juncture LEDs 336-1 and 336-4 will be energized inasmuch as the count in decade counter 332 is the same as before the half dollar was counted. However, a high will now appear at terminal 3 of counter 334, driving inverter 372-1 low and energizing LED 338-1. This provides a visual indication that a count of one (ten nickels or $0.50) has been stored in counter 334.

The final coin to be counted in the example at hand is a dollar. This coin interrupts all of the optical paths 133 between LEDs 114 and detectors 116 except that path 133-6 between LED 114-6 and detector 116-6. Consequently, LEDs 242-1–242-5 are energized; and highs appear at Ⓐ, Ⓑ, Ⓒ, Ⓓ, and Ⓔ. This drives inverters 266-1–266-4 low and inverters 342-1–342-2 high.

It will be apparent to the reader that this results in a single one of the NAND gates 244; viz., 244-5, being driven low. Inverter 268-5 is consequently driven high, applying a high to input 13 of Hex-D flip flop 264.

The subsequent imposition of the gate signal on input 9 of the flip flop causes a high to appear at output 12.

This drives inverter 270-1 low, providing one "dollar" count for remote counting equipment RCE.

The high also appears at input 4 of NOR gate 281 and at input 10 of AND gate 324; and it drives inverter 320 low, causing a low to appear at the input side of AND gate 316.

All other inputs to NOR gates 272 and 281 are low at this juncture as they are connected to terminals of flip flop 264 in that state. Consequently, the output of NOR gate 272 is high, the output of NOR gate 281 is low, the output of NAND gate 282 is high, inverter 286 is driven low, and LED 292 is energized.

With one input low, the output of AND gate 316 is low as is the output from AND gate 318 for the same reason. Lows consequently appear at the input of NOR gate 326 connected to the output of AND gate 318 and the input connected to the output of Schmitt trigger 360. And each negative to positive pulse from clock 296 driver inverter 298 low, causing the output of AND gate 312 to go low. Through inverter 374, this causes one input of AND gate 324 to go high. As the other input and gate 324 is now held high by output 12 of flip flop 264, the output of AND gate 324 goes high. This puts a high on one input of NOR gate 326 causing it to go low and thereby generating pulses for decade counter 332 and the remote counter through inverters 328 and 330.

It will be remembered from the description of the dime counting sequence that clock 296 and flip flop 310 combine to generate pulses for incrementing resettable decade counter 280 with the flip flop acting as a divide-by-two circuit in the count incrementing process.

However, as will be apparent from the immediately preceding discussion, the flip flop divide-by-two circuitry is bypassed, as far as count pulse generating NOR gate 326 is concerned, when a dollar is counted. Therefore, two counts are generated by inverters 328 and 330 each time that resettable counter 280 is incremented. Consequently, twenty pulses will have been applied to the remote counter and to decade counter 332 before a reset signal appears at terminal 12 of counter 280. In this manner, therefore, the 20 pulses indicative of a dollar are generated before the circuitry is reset.

Referring now to FIG. 12A, the first and eleventh pulses accumulated in counter 332 in counting the dollar fill that counter. Each time this occurs, counter 334 is incremented by one count and counter 332 reset to zero as discussed above.

In the example at hand, 19 pulses are stored in counters 332 and 334 prior to counting the dollar. Consequently, upon the completion of the dollar counting sequence, a total of 39 pulses will have been transmitted to counter 332; counter 334 will have been incremented three times; and counter 332 will contain a count of nine. This indicates that \$1.95 (\$0.05×39=\$1.95) has been counted. LEDs 336-1 and 336-4 will be energized, indicating that a count of 9 (1+8) has been accumulated in counter 332. Also, LEDs 338-1 and 338-2 will be energized, indicating that a count of 3 (1+2) has been accumulated in counter 334.

At this juncture, the information stored in decade counters 332 and 334 can be employed for a variety of purposes—for example, to turn traffic signal 34 green so that vehicle 28 can proceed; to increment a fare paid memory; to raise a lane gate; to dump the coins from escrow display 160 into coin vault 32; and to reset the coin counting circuitry.

Specifically, and referring to FIG. 12A, binary coded decimal (BCD) switches 376 and 378 are set for a count of 39 in the example on which the detailed description of my invention is based. This may be done manually, by computer, or microprocessor, or in any other desired manner.

Irrespective of the mechanism employed, the switches are set as shown in FIG. 11 to obtain a BCD count of 39. This connects the swingers 380-1 and 380-4 of switch 376 to outputs 3 (count of one) and 7 (count of 8) of conter 332 and the swingers 382-1 and 382-2 of switch 378 to outputs 3 (count of ten) and 2 (count of twenty) of counter 334. Highs are thereby put on the four associated inputs of NAND gate 386.

The remaining four swingers—380-2 and 380-3 of switch 376 and 382-3 and 382-4 of switch 378—are also positioned as shown in FIG. 11, connecting them to a +5 V power source 387. This results in highs being applied to the remaining inputs of NAND gate 386 as they are connected to the swingers just identified.

Consequently, when the pulse representing the thirty-ninth count appears at counter 332, highs appear at all inputs of gate 386; and its output goes low. This "fare paid" pulse or signal drives inverter 388 high, applying a high to input 2 of D flip flop 390.

Referring now to FIGS. 11, 12A, and 13, pulses from clock 296 are constantly applied to Ⓨ (FIGS. 11 and 13) and, consequently, to input 3 of flip flop 390 through a gate 391 (FIG. 13) which is driven low by each negative to positive transition of the clock and by an inverter 392 which is driven high as the gate output goes low (the highs appear at Ⓗ, FIGS. 12A and 13).

The first negative to positive transaction of clock 296 after the inverted fare paid signal is applied to its input 2 causes the flip flop to change states with a high appearing at terminal 5 and a low at terminal 6. This pulse or signal is also on occasion referred to hereinafter as a fare paid signal.

The pulse at flip flop terminal 6 drives a Schmitt trigger 393 low. This pulse is applied to a dual timer 394, triggering that device into its timing cycle. A high of specified duration consequentially appear at terminal 5 of the timer.

The low that thereupon appears at timer terminal 6 drives Schmitt trigger 395 high. This high, which appears at Ⓩ (FIGS. 12A and 11), drives the output of NOR gate 362 low, the output of Schmitt trigger 364 high, and the output of Schmitt trigger 366 low. A reset pulse is consequently applied to counter 348. That resets the counter, keeping any money represented by counts stored in it from being credited to the next patron of toll station 20.

The high at terminal 5 of dual timer 394 is applied to decade counters 332 and 334. That resets those counters, readying the circuitry described above for the counting of a subsequent toll. That operation can consequently proceed even though other operations initiated by the fare paid signal from NAND gate 386 have not been completed.

The high at dual timer terminal 5 also drives inverter 396 low. This low is applied to, and increments, a fare paid decade counter 398 by one count.

At the same time that the fare paid counter 398 is incremented and decade counters 332 and 334 cleared or reset, the low at flip flop 390 terminal 6 generates a reset pulse at input 13 on the other half of the flip flop, causing flip flop output 8 to go high. This results in the next clock pulse again triggering flip flop 390 and causing it to revert to its original state.

At the time that the fare paid counter 398 is incremented, a high appears at its output 3. This drives the output of NOR gate 400 low. The output of inverter 402 is driven high as the output of gate 400 goes low. Consequently, and depending upon the position of switch 404 (see FIG. 12B), a high or "fare paid" signal for operating ancillary equipment is available from either the fare paid counter 398 or the fare paid output or terminal 8 of flip flop 390.

Switch 404 is normally thrown to the full line position and the flip flop derived signal employed unless there is a lane gate or other barrier at the toll collection station. If there is, the switch is, typically, instead thrown to the dotted line position, coupling the fare paid counter into the active circuitry. In a manner that will be described below, this keeps the gate or other barrier from being restored to a traffic restraining position until a number of patrons equal to the number of paid fares has cleared the barrier.

Referring now to FIGS. 12B and 13, with switch 404 in the full line position, the high appearing at terminal 8 of flip flop 390 when that flip flop is triggered as described above drives the output of NAND gate low 406 as the other inputs to that gate are biased high as long as system 22 is energized. The same high drives inverter 407 low, causing the output of NAND gate 408 to go high.

The low from gate 406 energizes a "green light" relay 410, and the high at the output of gate 408 deenergizes a "red light" relay 412. As a consequence, a red light 414 in traffic signal 34 (see FIG. 1) goes out, and the green light 416 comes on.

At the same time that the green light relay is energized, the fare paid high available from flip flop 390 through switch 404 drives inverter 418 low. This causes inverter 419 to go high. The high appears at Ⓘ (see FIGS. 12B and 13).

Referring now to FIG. 13, the high appearing at Ⓘ drives inverter 422 low, applying a low to reset inputs 2 and 6 of flip flop 424. This causes flip flop output 12 to go low. That drives the output of NAND gate 426 high because two of the other three inputs are biased high and the third is high unless, as will be described below, there is a patron in the path of lane gate 38 (see FIG. 1).

The output of NAND gate 426 controls a relay 428 incorporated in a conventional controller (not shown) of a lane gate motor (likewise not shown) which can be operated in one direction to raise lane gate 38 and in the opposite direction to lower it. Consequently, the appearance of the fare paid signal results in gate 38 being raised so that the patron who paid the fare can depart from toll collection station 20.

A low can also be applied to NAND gate 426 by closing a manual override switch 432. By closing this switch, therefore, relay 428 can be energized and lane gate 38 raised (or lowered) regardless of whether or not a fare paid signal has been generated.

The traffic signal and lane gate 38 are operated in much the same manner when switch 404 is in the dotted line position and the fare paid signal is instead obtained from terminal 3 of fare paid counter 398. In that case, in addition, the fare paid high is applied to one input of NAND gate 435 (see FIG. 12B). This conditions the gate so that fare paid memory 398 can be decremented by one count when a patron encounters a cancellation loop 437 associated with lane gate 38 (see FIG. 1). Lane gate 38 is in this case closed only when the last of the patrons who have paid a fare leaves the influence of the cancellation loop as discussed below.

For operation with a cancellation loop input, the switch 438 shown in FIG. 13 is thrown to the dotted line position. With switch 438 in that position, entry of a fare paid patron into the field of influence of a cancellation loop can be employed to initiate the gate raising sequence as will be described hereinafter. The cancellation loop can be employed to initiate those sequences of operation which result in the lane gate being lowered, the green traffic light being extinguished, and the red light lit; the fare memory being decremented by one count; etc.

My novel system is so constructed that either pulse or presence type cancellation loops—both conventional—can be employed. Also, if a presence type loop is employed, cancellation can be effected either upon entry to or exit from the loop.

The interface between the cancellation loop and my novel system can be way of relay contact, TTL logic, etc. All that is required is that the interface be such that the input to which the cancellation loop is connected will normally have a high impressed on it and that this input be capable of going go ground (or low) when the cancellation loop is activated.

The cancellation loop output is connected to Ⓚ and Ⓛ (see FIG. 13) and to either Ⓜ or Ⓝ (see FIG. 12A), depending upon whether the loop is of the presence or pulse type. In both cases the input from the loop is handled in much the same manner.

For purposes of illustration, it will be assumed that the output from the cancellation loop consists of class C relay contacts. These are identified by reference character 440 in FIG. 13.

In this case, switch 442 (FIG. 12A) is thrown to the illustrated position. With an inductive loop and class C relay contacts connected as just described, the loop will remain activated as long as a vehicle is in its field of influence. When a patron is not present in the field of influence of cancellation loop 437, relay contacts 440 are positioned as shown in FIG. 13; and a low is imposed on inverter 446, driving it high. This inverter, and a second inverter 448 associated with it as shown in FIG. 13, constitute a debounce network. That network keeps the various circuits responsive to the activation of the cancellation loop from being triggered by contact bounce.

The high on the output of inverter 446 is also applied to Ⓝ (see FIGS. 13 and 12A). That fulfills the condition that a high be applied to the input from the cancellation loop when no patron is within its influence.

When a patron enters the influence of the cancellation loop, its relay (not shown) is energized, causing contacts 440 to transfer. This drives inverter 448 high and inverter 446 low. The low at the output of inverter 446 appears at Ⓝ (FIGS. 13 and 12A). This causes trigger input 8 of dual timer 394 to go low.

Timer output 9 consequentially goes high for a period determined by a timing circuit composed of resistor 452 and capacitor 454. This high is applied to input 2 of NAND gate 435 which, at this juncture, already has one high established by the fare paid high appearing at switch 404 from fare paid counter 398. Consequently, application of the high resulting from a patron exiting through cancellation loop 437 to NAND gate 435 drives the gate low. The low is applied to input 4 of the fare paid counter 398, decreasing the count in that counter by one.

If only one fare paid count has been stored, this counter will now be set at zero. However, if more than one fare has been paid but all "fare paid" patrons have not yet cleared the cancellation loop, the sequence will be repeated until the number of patrons equalling the number of paid fares have cleared the loop.

Assuming then that only one count has been stored, and that counter 398 has consequently been reset to zero by a patron clearing cancellation loop 437, lows will appear at outputs 2, 3, and 6 of fare paid counter 398. NOR gate 400 is accordingly driven high as all its inputs are low, and inverter 402 goes low. With switch 404 set in the "memory" position shown in dotted lines in FIG. 12B, inverter 407 consequentially goes high; and the outputs from gates 406 and 408 go high and low, respectively, energizing relay 412 and deenergizing relay 410. This resets traffic signal 34 with the green light 416 going out and the red light 414 coming on.

At the time the high at output 9 of timer 394 initiates the sequence of events just described, it drives the output of Schmitt trigger 456 (see FIG. 12A) low. That places a low on reset terminal 12 of flip flop 390. It also resets the counting circuitry and readies it for the counting of a subsequent toll.

Referring now to FIG. 12B, and irrespective of the setting of switch 404, that low at the output of NAND gate 435 which results in counter 398 being decremented in the fare paid memory type of operation is also applied to input 6 of a dual timer 458. This produces a high at timer output 5 which is put on an input of NAND gate 460. Absent a violation and with a coin vault in place, the other inputs to gate 460 are high; and the timer derived high consequently drives the output of gate 460 low. This low, which appears at Ⓞ, energizes solenoid 182 (see FIG. 6), allowing the coins in escrow display 160 to drop into coin vault 32.

Referring now to FIGS. 1 and 12B, a microswitch 462 (shown only in FIG. 12B) is wired between solenoid 182 and Ⓞ. This switch is mounted on escrow display side member 162 adjacent the top cover 170 of the escrow display and is biased open by it.

When cover 170 is opened—for example, to allow evidence of toll violations to be removed from the escrow display—switch 462 closes, placing a low on an input to gate 460. Consequently, the gate output cannot go low to actuate the dump solenoid despite the presence of a "dump" signal at terminal 5 of timer 458.

Referring now specifically to FIG. 12B, the dump signal from terminal 5 of timer 458 is also applied to the input of inverter 464, driving the output low and producing a low at Ⓟ. This can be employed to energize a remote "fare paid" display or indicator (not shown).

Turning next to both FIGS. 6 and 12B, it was pointed out above that it may on occasion be advantageous to disenable escrow display 160 and that this can be done by rotating crank 198 to the position shown in phantom lines in FIG. 6. As this is done, a switch 466 mounted adjacent the handle 200 of the crank is closed. This switch is wired in parallel with the switch 462 illustrated in FIG. 12B; and it accordingly has the same effect. That is, when the switch is closed, a low is applied to an input of NAND gate 460, biasing the output of that gate high and thereby keeping solenoid 182 from being actuated.

Referring now to FIGS. 12A, 12B, and 13, the departure of a patron from the influence of the cancellation loop results in the relay of the cancellation loop being deenergized. Consequently, the relay contacts 440 transfer, the output of inverter 446 goes high, and the output of inverter 448 goes low. This puts a reset pulse on terminal 1 of flip flop 424. A high thereupon appears at flip flop output 12 and at one input of NAND gate 426.

The other two inputs of NAND gate are also high because of the just discussed high at the output of inverter 446 and because inverter 422 has been driven low in energizing relay 428 to effect the raising of lane gate 38.

The output of gate 426 consequently goes low. This again energizes relay 428; and the lane gate motor is actuated, but in the opposite direction, to lower lane gate 38.

If a patron enters the influence of a cancellation loop without a fare paid signal having been generated, a high will appear at NAND gate 435 by virtue of the sequence discussed above. In this circumstance, however, flip flop 390 does not change states because the trigger signal from gate 386 is not generated. Therefore, one input of gate 435 will remain low; its output will be high; timer 458 cannot be triggered; and solenoid 182 cannot be energized.

In the case of a violation, the high appearing at gate 435 is also placed on one input of NAND gate 467. A second high is applied to NAND gate 467 from inverter 407 because terminal 8 of flip flop 390 remains low if switch 404 is in the solid line position and because terminals 2, 3, and 6 of fare paid counter 398 are low, the output of NOR gate 400 high, and the output of inverter 402 low if switch 404 is in the dotted line position.

The two highs on the inputs of gate 467 drive its output low. The low is placed on input 8 of dual timer 458. This produces a timed pulse at terminal 9 which drives inverters 468, 470, and 472 low.

The low at the output of inverter 468 is applied to a NAND gate 474, driving it high and producing a high at Ⓠ to actuate a violation alarm (not shown).

Inverter 470 produces a low at Ⓡ. This actuates a "violation" counter in the remote counting equipment.

The simultaneously occuring low at the output of inverter 472 is applied through Ⓥ to inverter 476 (see FIG. 13). That drives the output of inverter 476 high, putting a high on one input of NAND gate 478. The other input is high in the absence of a series of violations; and the pulse from inverter 476 accordingly drives the output of the gate low, incrementing a "violation" counter 480 by one count.

Counter 480 has outputs 1, 2, 3, 4, 6, and 7 connected to the contacts of switch 482. Depending on how the switch contactors are set, a NAND gate 484 on the output side of the switch will be driven low after the generation of 1, 2, 3, 4, 5, or 6 consecutive violations by highs put on its inputs through switch 482.

The low appearing at the output of NAND gate 484 if the number of consecutive violations reaches the preselected total is applied to input 6 of timer 486. This results in a high appearing at output 5 of the timer and being applied to one input of NAND gate 488. Because the other inputs of that gate are permanently biased high, the pulse from timer 486 drives the output of NAND gate 488 low, causing a low to appear at S. This energizes the solenoid 148 of the scavenge dump (see FIG. 5), opening trap door 142. Bent coins, foreign objects, etc. which may have accumulated on the upstream side of the coin separator cylinder 78 thereupon drop off the platform 46 of coin slide assembly 44, and coins kept from moving past the separator cylinder by such foreign objects are again free to do so.

To insure that the dump or scavenge solenoid is actuated only after the predetermined number of consecutive violation indicative signals have been generated, counter 480 is reset to zero by each fare paid transaction; i.e., each time that a fare paid signal appears at the output of gate 386 (or flip flop 390).

Specifically, it will be remembered that the appearance of a fare paid signal results in the energization of a green light relay 410 (see FIG. 12B) and that this signal, taken from the output side of switch 404, is applied to inverter 418, driving it low. The low appears at Ⓣ (FIGS. 12B and 13) and is applied to one input of a NAND gate 490 (FIG. 13). This drives the output of the gate high, applying a reset signal to input 14 of consecutive violations counter 480.

Counter 480 can also be reset by closing a manual switch 492 (see FIG. 13) as this too causes a low to appear at an input of NAND gate 490 and drive its output high.

The exemplary circuit shown in FIG. 13 is also designed to turn off the motor 94 of coin separator unit 40 after eight consecutive violation signals have been generated. This is taken as evidence that a definite malfunction has occurred.

Specifically, when counter 480 is incremented for the eighth time, a high appears at counter output 7, driving inverter 494 low. This causes the output of NAND gate 496 to go high. The high, which appears at Ⓤ, is employed to open a circuit in a conventional controller (not shown) for motor 94.

The low from the output of inverter 494 is also put on an input of NAND gate 478. This drives the gate output high, thereby keeping additional counter triggering pulses from reaching counter 480.

At the same time, a high is applied from counter output 7 to the input of inverter 498, driving it low. This energizes LED 500, visually indicating that motor 94 is no longer running because the specified number of consecutive fare violation signals has been generated.

Once the reason for the appearance of the eight consecutive violation signal has been ascertained, counter 480 and the associated circuitry can be reset by closing the manual switch 492 identified above. This puts a low on an input of NAND gate 490, driving its output high and thereby applying a reset signal to terminal 14 of counter 480 as discussed above.

It was also pointed out above that advantage can be taken of a conventional entry loop to produce a "timed" operation of coin sorter unit motor 94 that will result in the motor being deactivated during period when no patrons are present, thereby saving wear and tear on the motor and moving components operated thereby. The entry loop is identified by reference character 502 in FIG. 1, and its output is represented by switch 504 in FIG. 13.

Referring still to the Figures just mentioned, the entry of a patron or his vehicle into the influence of loop 502 causes switch 504 to close and an input of NAND gate 506 to go low. This drives the output of gate 506 high.

With switch 508 in the position shown in full lines in FIG. 13, as it is for the entry loop mode of operation, that high is put on gate 496. In the normal absence of the consecutive number of violations needed for a high to appear at terminal 7 of counter 480, the output of inverter 494 is high, putting a high on a second input of gate 496. And the remaining input is high with a coin vault in place as will be discussed below. Consequently, the high put on gate 496 from gate 506 drives gate 496 low; and the low appears at Ⓤ to energize the motor 94 of coin separator unit 40.

The same high signal is, in addition, applied to inverter 512, driving it low and energizing LED 514 to indicate that the coin sorter unit motor is running.

The high from gate 506 is also applied to inverter 510, driving its output low. That low is applied to terminal 8 of, and triggers, one side of dual timer 516. A high consequently appears at terminal 9 of the timer.

This high is applied to inverter 517, driving its output and one input to NAND gate 518 low. The gate output consequentially goes high for a period of short duration, deenergizing a relay 519 typically incorporated in the control circuit of coin sorter unit motor 94 to control its direction of rotation. As a consequence, motor 94 will always be started through the entry loop associated circuitry just described in the forward or coin sorting direction indicated by arrow 520 in FIG. 4.

The gate 506 can also be employed to reset fare paid counter 398 to zero. This is done to remove any fares paid which may have been inadvertently left stored in counter 398 when no vehicles are present. When the output of gate 506 goes low, inverter 521 goes high. This high is applied to Schmitt trigger 522, driving its output low, which in turn drives Schmitt trigger 523 high, putting a high on the reset input of counter 398, thereby resetting it to zero.

As will be apparent from the discussion of the cancellation loop mode of operation, this resetting of the fare paid counter also insures that the red light 414 will be on, lane gate 38 lowered, and the circuitry of the system set for processing a fare in the manner described above when a patron approaches a toll collection station 20.

Coincidentally with the foregoing, the low generated by the closing of switch 504 is applied to inverter 524, driving its output high. It also impresses a temporary low on the reset input 4 of dual timer 516. This resets the timer, putting a low on timer output 5. When switch 504 returns to its normal open position due to the vehicle leaving the area of influence of the entry loop, the output of inverter 524 is driven low, causing a low to appear on trigger input 6 of timer 516 through capacitor 525. This initiates a timing cycle, causing output terminal 5 of the timer to go high.

The high at terminal 5 is applied to both inputs of NAND gate 526, driving its output low. That low is applied to the second input of NAND gate 506. Consequently, even though the patron leaves the influence of entry loop 502, the output of gate 506 will remain high, and motor 94 will be energized until timer 516 times out.

When this occurs, the gate input biased low by gate 526 goes high, and the second input will have already become high due to the patron leaving the influence of the entry loop and switch 504 opening. Consequently, the output of gate 506 goes low. This results in motor 94 being deenergized and LED 514 being extinguished as gate 496 and inverter 512 are consequentially driven high.

The motor 94 of coin separator unit 40 can also be operated independently of the presence of a patron within the influence of the entry loop by closing manual switch 528 if switch 508 is in the position shown in FIG. 13. This produces the same sequence of operation as that initiated by the presence of a patron within the influence of the entry loop except that only the right-hand side of dual timer 516 is triggered. Consequently, motor 94 continues to run until switch 508 is opened. This mode of operation can accordingly be employed for maintenance purposes or in applications not involving an entry loop.

As indicated above, it is a feature of my invention that the direction of rotation of motor 94 can automatically be reversed for a period of specified duration to clear such jams as may infrequently occur.

Specifically, with particular reference to FIGS. 3 and 13, coin separator unit 40 is equipped with a conventional pulse generator 530 which includes a segmented wheel 532 mounted on the shaft 80 of separator cylinder 78. As long as separator cylinder 78 is rotating freely in the forward direction, a continuous series of pulses will be generated by the generator.

These pulses appear at Ⓧ (see FIG. 13). Inverter 534 (see FIG. 13) is consequently driven low each time a pulse appears.

The lows are applied to terminal 8 of timer 486, causing a corresponding series of highs to appear at output 9. These are smoothed into a continuous high by capacitor 535 and resistor 536. The high is applied to inverter 538, driving it low and applying a low to NAND gate 518 as long as the separator cylinder is turning freely. This keeps the output of gate 518 high, motor direction relay 519 deenergized, and separator cylinder 78 rotating in the forward direction indicated by arrow 520 in FIG. 4.

Should the separator become jammed and stop rotating, however, no pulses will be generated, and a continuous low will appear at Ⓧ. This drives the output of inverter 534 high, putting a high on input 8 of timer 486. With a constant high on trigger input 8, timer 486 times out, put a constant low on timer output 9.

This low is placed on, and drives inverter 538 high, causing a high to appear at the associated input of NAND gate 518. The other inputs to the gate are also high because the right-hand side of timer 516 will have run, making output 9 low and the output of inverter 517 high, and because the output from gate 506 is high until the other side of the dual timer times out.

Consequently, the output of NAND gate 518 goes low if separator cylinder 78 jams. This results in the direction controlling relay 519 being energized and motor 94 and separator cylinder 78 rotating in the reverse, jam clearing direction indicated by arrow 539 in FIG. 4. As the motor starts to rotate in the reverse direction, the segmented wheel 532 causes the pulse generator to once again produce a pulse, which is applied to timer 516 through inverter 534. This causes timer output 9 to go high, putting a low on NAND gate 518, thereby deenergizing the direction relay 519 and once again causing motor 94 to rotate in the forward direction.

In conjunction with the foregoing, it is by no means necessary that the sequence of automatic coin sorter motor operation just described be initiated by an entry loop. Alternatives that can be employed are a photocell, a switch actuated by the deposit of the first coin in basket 30, etc.

Referring now especially to FIGS. 11 and 13, it was pointed out above that another important feature of my invention is that coins cannot be counted unless a coin vault or other depository is in place. Specifically, unless this is the case, a (typically magnetic) switch 540 actuated by the coin vault is open. In this circumstance, a high is put on inverter 542. The output of inverter 542 is consequently driven low; and the output of NAND gate 496 goes high. A high thus appears at Ⓤ, and motor 94 of coin separator unit 40 cannot be energized because that requires that a low be placed on Ⓤ as discussed above.

With switch 540 open, inverter 544 is also driven low. This low is applied to NAND gate 391, keeping the clock pulses generated by clock 296 (see FIG. 11) from driving the gate output low. Consequently, flip flop 390 cannot be triggered by inverter 392; and the sequence of events described above which is normally initiated when a fare paid signal is applied to the flip flop is precluded.

Many different types of counters and other integrated circuit type devices can be employed in circuitry embodying the principles of the present invention. The devices utilized in the particular circuitry discussed above and illustrated in the drawing are:

decade counters 280, 332, 334, 398 and 480; type 74192;
decade counter 348; type 74196;
flip flop 264; type 74174;
flip flops 284 and 390; type 7474;
flip flops 310 and 424; type 7473
timers 394, 458, and 516; type 556; and
one shot 256: type 74123.

The invention may be embodied in other specific forms without departing from the spirit or essential characteristics thereof. The present embodiment is therefore to be considered in all respects is illustrative and not restrictive, the scope of the invention being indicated by the appended claims rather than by the foregoing description; and all changes which come within the meaning and range of equivalency of the claims are therefore intended to be embraced therein.

What is claimed and desired to be secured by Letters Patent is:

1. Coin counting apparatus or the like comprising: a coin identification system including means for generating a separate, distinct signal indicative of the value of each countable coin; means for coincidentally generating a gating signal; and means for converting each of said first-mentioned signals to a series of pulses representative of the monetary value of the coin identified by the signal, the means for generating each of the aforesaid coin value indicative signals comprising at least one light source and a detector circuit means associated with each light source for generating a signal when the optical path between the detector and the light source is interrupted, the means for generating the gating signal comprising a light emitting source and a detector circuit means as aforesaid on opposite sides of an optical path that is interruptable by any of the countable coins at the time that the signal indicative of the value of that coin is being generated to generate a position indicative signal, the means for converting the value indicative signals to the corresponding series of pulses comprising a solid state device which changes states when any one of said value indicative signals and the amplified, position indicative signals are applied thereto, and said coin identification system further including means energizable coincidentally with the generation of coin value indicative and gating signals for providing indications that the means employed to produce said coin value indicative and gating signals has functioned properly.

2. Coin counting apparatus or the like comprising: a coin identification system including means for generating a separate, distinct signal indicative of the denomination of each countable coin; means for coincidentally generating a gating signal; and means triggered by said gating signal for converting each of coin value indicative signals to a series of pulses representative of the monetary value of the coin identified by the signal which comprises: information processing means; encoding means for applying each signal indicative of coin denomination to a different input of the information processing means; means for applying the gating signal to said information processing means and thereby causing a signal indicative of the denomination of the coin being counted to appear at an output of the information processing means that is separately and distinctly associated with that denomination; a first counter; encoding means effective upon the appearance of a signal at certain ones of the outputs of said information processing means to preset said counter with a count determined by the denomination of the coin being counted; means including a clock and at least one bistable device that is caused to change states by pulses from said clock that is effective when a signal appears at an output of said information processing device that is indicative of coin denomination to generate a train of counter incrementing pulses and apply said pulses to said first counter; and a second counter which is concurrently incremented by the same count, whereby when said first counter is filled, said second counter will have been incremented by a count indicative of the monetary value of the coin that was counted.

3. A system as defined in claim 2 which also includes means effective upon the appearance of a signal at an output of said information processing means for generating a coin denomination indicative signal for remote counting equipment or the like.

4. A system as defined in claim 2 which includes means effective upon the appearance of a signal at an output of said information processing means to energize a visual indicator and thereby provide an indication that the information indicative of the denomination of the coin being counted has become available at an output of said information processing means.

5. A system as defined in claim 2 which includes a pulse divider means between said bistable device and said first counter for reducing the number of pulses supplied to the first counter to a selected fraction of those supplied to the second, cumulating counter, whereby a coin having a value represented by more pulses or counts than can be stored in said first counter can be counted.

6. A system as defined in claim 5 wherein the pulse divider means also includes means for causing said bistable device to return to its original state following each instance in which said device has been caused to change states by said clock.

7. A system as defined in claim 2 which includes a third counter to which the pulses generated by the means including said clock and said bistable device are applied instead of second counter when a signal appears at that output of the information processing means that is associated with the countable coin of least value and means effective when said third counter has been incremented by a selected number of pulses to reset said third counter and to apply a counter incrementing pulse to said second counter, whereby the counts stored in said second counter can be made to represent monetary values which are multiples of that possessed by said coin of least value.

8. A system as defined in claim 2 which includes means operable concurrently with the application of a counter incrementing pulse to said second counter to also generate a corresponding operating pulse for remote counting equipment.

9. A system as defined in claim 2 which includes means that is effective upon the application of a counter incrementing pulse to said second counter to generate a visual display indicative of the number of pulses or counts stored in said second counter.

10. A system as defined in claim 2 which includes a fourth counter and means effective when said second counter is filled to reset said second counter and to increment said fourth counter.

11. A system as defined in claim 10 which includes means that is effective upon the application of counter incrementing pulses to said fourth counter to generate a visual display indicative of the numbers of counts stored in said fourth counter.

12. Apparatus for processing coins or the like comprising: a coin separator; means for storing a monetary value related count of the coins processed through said separator; a signal gene rator with two input means, said signal generator being capable of generating a signal when signals representative of matched counts are applied to both of said input means; means comprising a programmable switch means for applying to one of said signal generator input means a signal representing a count indicative of a selected monetary value; and means connecting said count storing means to the second of said input means whereby, when the stored count matches the selected count, a signal resulting in the signal generating actuation of said signal generating means will be applied to the second input of the latter.

13. A toll collection system or the like comprising: coin counting apparatus which includes a presettable counter means; a cumulating counter means; means for identifying the denominations of a coin being counted and presetting the presettable counter means to a first count which, incremented by a second count representative of the denomination of the coin, will fill the presettable counter means and increment said cumulating counter means by said second count; and means operable coincident with the incrementing of said resettable counter means by said second count for resetting it, thereby readying the apparatus for the counting of a subsequent coin while leaving in the cumulative counter means a count representative of the value of the counted coin or coins, said system also including means effective when the count in said cumulative counter means reaches a selected total to generate a fare paid signal; and means responsive to the fare paid signal to reset said cumulative counter means to zero.

14. A system as defined in claim 13 which is selectively programmable to the total at which the fare paid signal will be generated.

15. A system as defined in claim 13 wherein the coin counting apparatus of the system also comprises a third counter means which is incremented in the stead of said cumulative counter means as each coin of said least value is counted, means effective when said third counter means has been incremented to a multiple equalling the value represented by storing by one count in said cumulative counter means to reset said third counter means to zero and to increment said cumulative counter means, and means which is effective when a fare paid signal appears to reset said third counter means to zero irrespective of the count then stored therein so that coins of said least value deposited at said station by one patron and represented by a count in said third counter means are not credited to the fare due from the next patron.

16. A toll station or the like which comprises: means for generating a fare paid signal; traffic control means for indicating that a patron may, or allowing the patron to, exit from the station; operating means for actuating said traffic control means to a go condition upon receipt of a fare paid signal and for subsequently transferring said traffic control means to a stop condition after it has been cleared by the patron; a fare paid memory; means for storing a count in said memory coincident with the generation of each fare paid signal; means for decrementing the count in said memory as a patron clears said traffic control means; and means for preventing said operating means from transferring said traffic control means from the go condition to the stop condition until the count in said memory has been decremented to zero, thereby insuring that all patrons that have paid fares have cleared said traffic control means before it is transferred to said stop condition.

17. Toll collection equipment comprising: coin receiving means; means for sorting and counting coins deposited in said coin receiving means which includes a separator and a motor for operating said separator, a removable and replaceable coin vault for receiving the sorted and counted coins, and means including a vault-engageable switch for keeping said coin sorting and counting means from operating in the absence of a coin vault in coin receiving relationship therewith.

18. A toll collection station or the like which comprises: a receptacle means in which coins can be deposited by a patron arriving at said station, means for sorting and counting said coins which includes a separator and a motor for operating said separator, and means including solid state circuitry which is automatically activated by the arrival of the patron at the toll station or by his deposit of a coin in said receptacle means for effecting the energization of said motor and the consequential operation of said separator.

19. A toll collection station as defined in claim 18 in which includes concurrently activated timer means included in said solid state circuitry for effecting the subsequent deenergization of said motor, thereby saving wear and tear on said motor and said separator.

20. A station as defined in claim 18 which includes means incorporating said solid state circuitry for manually overriding said automatically activated means and effecting operation of said moto and said separator irrespective of the presence or absence of a patron at the toll station or of the deposit of a coin by said patron.

21. Toll collection equipment or the like comprising: coin receiving means, means for sorting and counting coins deposited in said coin receiving means which includes an escrow display for the counted coins and for slugs and other foreign objects, a receptacle to which coins can be transferred from said escrow display, means for generating a fare paid signal as soon as a patron deposits coins indicated by the coin sorting and counting means to total a selected amount in said coin receiving means and for generating a violation signal if the patron passes the equipment without a fare paid signal having been generated, means actuatable by the generation of a fare paid signal to effect the transfer of coins from said escrow display to said receptable, and means responsive to the generation of a violation signal for inhibiting the actuation of that means which effects the transfer of the coins from the escrow display to the coin receptacle.

22. A sorter for coins and like objects comprising: an inclined, tilted slide having a biased closed trapdoor therein; means via which coins can be introduced onto said slide at the upper end thereof; separator means for marshalling said coins into single file as they proceed down said slide; and means which can be activated to open said trapdoor and dump bent coins or foreign objects trapped on said slide by said separator means from said slide, said last-mentioned means comprising a fixedly mounted relay having a displaceable armature, a fixedly mounted pulley, and a flexible connector trained around said pulley, one end of said connector being fixed to said armature and the other end of said connector being fixed to said trapdoor.

23. Coin counting apparatus or the like comprising: a coin denomination identification system including means for generating a separate, distinct signal indicative of the value of each countable coin and means for coincidentally generating a gating signal; means triggered by said gating signal for converting each of said coin value indicative signals to a series of pulses representative of the monetary value of the coin identified by the signal; and means energized coincidentally with the generation of each coin value indicative signal via the means provided for generating said coin value indicative signals and independently of the generation of said gating signal for providing a visual indication that the means by which that signal was generated is functioning properly.

24. A sorter for coins and like objects comprising: an inclined, tilted slide; a rail extending along the lower side of said slide; means via which coins can be introduced onto said slide at the upper end thereof; means for aligning said coins in single file and in sliding relationship to said slide and for guiding said coins to said rail which comprises a separator spanning said slide, means mounting said separator above said slide for rotation about an axis which is parallel to said slide and extends transversely thereacross, and motor means for rotating said separator in a forward direction corresponding to the direction of movement of the coins down said slide; and means operable coincidentally with the occurence of a jam for reversing the direction of rotation of said separator and thereby clearing the jam.

25. A sorter as defined in claim 24 wherein the means for reversing the direction of rotation of said separator comprises a bistable device for controlling the direction of rotation of said motor means; means including a pulse generator having a component rotatable with said separator which is operable to generate and apply to said bistable device a signal effective to maintain said device in a first state in which it causes said motor means to rotate in said forward direction whereby, when a jam occurs, and said separator and said pulse generator component stop rotating, said signal will cease to exist, resulting in said bistable device switching to its second state and in said motor means consequentially rotating in said reverse direction.

26. A sorter as defined in claim 25 which includes timer means activated concurrently with the switching of said bistable device to its second state for subsequently causing said device to switch back to its first state and thereby cause said motor to resume rotation in said forward direction.

27. A toll station or the like which includes: a coin separator; means for storing a monetary value related count of the coins processed through said separator; a signal generator with two input means, said signal generator being capable of generating a signal when signals representative of matched counts are applied to both of said input means; programmable means for applying to one of said signal generator input means a signal representing a count indicative of a selected monetary value; means connecting said count storing means to the second of said input means whereby, when the stored count matches the selected count, a signal resulting in the signal generating actuation of said signal generator will be applied to the second input of the latter; at least one means with an operating cycle initiated by a signal generated by said signal generator; a fare paid memory; means for incrementing the count in the fare paid memory coincidentally with the generating of said signal; and means operable coincidentally with the incrementing of the fare paid memory for resetting the means in which the monetary value related count is stored and thereby making said apparatus available for a subsequent processing of coins even though said operating cycle has not been completed.

28. A toll collection station or the like which includes: a coin separator; means for storing a monetary value related count of the coin processed through said separator; a signal generator which is capable of generating a signal when first and second signal representative of matched counts are applied thereto; programmable means for applying to said signal generator a first signal representing a count indicative of a selected monetary value; and means so connecting said count storing means to said signal generator that, when the stored count matches the selected count, a second signal resulting in the signal generating actuation of said signal generating means will be applied thereto; a barrier; means activatable to displace said barrier from a first position to a second position to allow a patron therepast and for subsequently restoring said barrier to said first position; means responsive to the generation of a signal by said signal generator to activate said barrier displacing means; and means responsive to the physical presence of a patron for overriding the means that activates the barrier displacing and restoring means and thereby insuring that the patron has cleared said barrier before the latter is restored to said first position thereof.

29. A toll collection station or the like which includes: a coin separator; means for storing a monetary value related count of the coins processed through said separator; a signal generator which is capable of generating a signal when first and second signals representative of matched counts are applied thereto; programmable means for applying to said signal generator a first signal representing a count indicative of a selected monetary value; and means so connecting said count storing means to said signal generator that, when the stored count matches the selected count, a second signal resulting in the signal generating actuation of said signal generating means will be applied thereto; a barrier; means activatable to displace said barrier from a first position to a second position to allow a patron therepast; means responsive to the generation of a signal by said signal generator to activate said barrier displacing means; and means for manually activating said barrier displacing means and thereby displacing said barrier between said first and second positions without a signal having been generated by said signal generating means.

30. Coin counting apparatus or the like comprising: a presettable counter means; a cumulating counter means; means for identifying the denomination of a coin being counted and presetting the resettable counter means to a first count which, incremented by a second count representative of the denomination of the coin, will fill the presettable counter means and increment said cumulating counter means by said second count; and means operable coincident with the incrementing of said resettable counter means by said second count for resetting it, thereby readying the apparatus for the counting of a subsequent coin while leaving in the cumulative counter means a count representative of the value of the counted coin or coins, each count as aforesaid representing a multiple of the value of the countable coin of least value and said apparatus also including a third counter means which is incremented in the stead of said cumulative counter means as each coin of said least value is counted and means effective when said third counter means has been incremented to said multiple to reset said third counter means to zero and to increment said cumulative counter means.

31. Coin counting apparatus or the like comprising: a presettable counter; a cumulating counter means; means for identifying the demonination of a coin being counted and presetting the resettable counter to a first count which, incremented by a second count representative of the denomination of the coin, will fill the presettable counter and increment said cumulating counter means by said second count; means operable coincident with the incrementing of said resettable counter by said second count for resetting it, thereby reading the apparatus for the counting of a subsequent coin while leaving in the cumulative counter means a count representative of the value of the counted coin or coins; and means effective with the counting of the highest denomination coin countable to increment said cumulative counter means by a multiple of more than one each time the resettable counter in incremented, whereby a coin represented by the number of counts that are storable in said resettable counter times the multiplier can be counted.

32. Coin counting apparatus or the like comprising: a presettable counter; a cumulating counter means, means for identifying the denomination of a coin being counted and presetting the resettable counter to a first count which, incremented by a second count representative of the denomination of the coin, will fill the presettable counter and increment said cumulating counter means by said second count; and means operable coincident with the incrementing of said resettable counter by said second count for resetting it, thereby readying the apparatus for the counting of a subsequent coin while leaving in the cumulative counter means a count representative of the value of the counted coin or coins, said cumulative counter means comprising first and second counters and means operable when said first counter is filled to reset said first counter and to increment said second counter.

33. Toll collection equipment comprising: coin receiving means, means for sorting and counting coin deposited in said coin receiving means which includes a coin slide assembly and a dump which can be actuated to remove bent coins and foreign objects from said coin slide assembly; means including solid state circuitry for generating a fare paid signal if a patron deposits coins indicated by the coin sorting and counting apparatus to total a selected amount in said coin receiving means and for generating a violation signal if the patron passes the equipment without a fare paid signal having been generated; and means which includes said solid state circuitry and which is responsive to the generation of a violation signal or a selected number of successive violation signals for actuating said dump, thereby avoiding the generation of false violation signals because of the inability of said coin separator to function properly because of bent coins or foreign objects being trapped on said coin slide assembly.

34. Toll collection apparatus comprising: coin receiving means; means for sorting and counting coins deposited in said coin receiving means which includes a separator and a motor for operating said separator; means for generating a fare paid signal if a patron deposits coins indicated by the coin sorting and counting apparatus to total a selected amount in said coin receiving means and for generating a violation signal if the patron passes the equipment without a fare paid signal having been generated; and means responsive to the generation of a selected number of successive violation signals for terminating the operation of said coin sorting and counting apparatus by halting said motor.

35. A toll collection station or the like which comprises: a receptacle means in which coins can be deposited by a patron arriving at said station; means for sorting and counting said coins which includes a separator and a motor for operating said separator; means automatically activated by the arrival of the patron at the toll station or by his deposit of a coin in said receptacle means for effecting the energization of said motor and the consequential operation of said separator; timer means activated concurrently with the energization of said motor for effecting the subsequent deenergization of said motor, thereby saving wear and tear on said motor and said separator; a traffic control device which is actuatable between stop and go conditions; means effective when the coins deposited by the patron and passed by said separator reach a selected total value to effect the actuation of said traffic control device from the stop condition to the go condition; and means activated by said timer means concurrently with the deenergization of said motor for restoring said traffic control device to said stop condition.

36. Toll collection equipment or the like comprising: coin receiving means, means for sorting and counting coins deposited in said coin receiving means which includes an escrow display for the counted coins and for slugs and other foreign objects, a receptacle to which coins can be transferred from said escrow display, means for generating a fare paid signal if a patron deposits coins indicated by the coin sorting and counting means to total a selected amount in said coin receiving means and for generating a violation signal if the patron passes the equipment without a fare paid signal having been generated, means actuatable by the generation of a fare paid signal to effect the transfer of coins from said escrow display to said receptacle, means responsive to the generation of a violation signal for inhibiting the actuation of that means which effects the transfer of the coins from the escrow display to the coin receptacle, and a manual override for disenabling the violation signal responsive means.

37. Toll collection equipment or the like comprising: coin receiving means, means for sorting and counting coins deposited in said coin receiving means which includes an escrow display for the counted coins and for slugs and other foreign objects, a coin receptacle to which coins can be transferred from said escrow display, means for generating a fare paid signal if a patron deposits coins indicated by the coin sorting and counting means to total a selected amount in said coin receiving means and for generating a violation signal if the patron passes the equipment without a fare paid signal having been generated, means actuatable by the generation of a fare paid signal to effect the transfer of coins from said escrow display to said receptacle, and means responsive to the generation of a violation signal for inhibiting the actuation of that means which effects the transfer of the coins from the escrow display to the coin receptacle, said escrow display having a displaceable access means and said equipment also including means responsive to access affording displacemenmt of said access means for inhibiting the actuation of that means which affects the transfer of the coins from the escrow display to the coin receptacle.

38. Toll collection equipment or the like comprising: coin receiving means; means for sorting and counting coins deposited in said coin receiving means which includes an escrow display for the counted coins and for slugs and other foreign objects, said escrow display having a displaceable cover means; a receptacle to which coins can be transferred from said escrow display; means for generating a fare paid signal if a patron deposits coins indicated by the coin sorting and counting means to total a selected amount in said coin receiving means; means actuatable by the generation of a fare paid signal to effect the transfer of coins from said escrow display to said receptacle; means responsive to the generation of a violation signal for inhibiting the actuation of that means which effects the transfer of the coins from the escrow display to the coin rexeptacle; and means responsive to access affording displacement of said access means for inhibiting the actuation of that means hwich effects the transfer of the coins from the escrow display to the coin receptacle.

39. A sorter for coins and like objects comprising: an inclined slide; means via which coins can be introduced onto said slide at the upper end thereof; means for aligning said coins on said slide which comprises a separator spanning said slide and means rotatably mounting said separator above said slide; escrow means downstream from said separator for accumulating and displaying those objects which pass said separator; means affording manual access to said escrow means for removing objects therefrom; means for transferring coins from said escrow means to a removable coin repository; and means effective when said manual access affording means is manipulated to prevent the transfer of coins from said escrow means to said repository, said last-mentioned means comprising an electrical switch means which is caused to change states by the removal and replacement of said repository.

40. A sorter for coins and like objects comprising: an inclined slide; means via which coins can be introduced onto said slide at the upper end thereof; means for aligning said coins on said slide which comprises a separator spanning said slide and means rotatably mounting said separator above said slide; escrow means downstream from said separator for accumulating and displaying those objects which pass said separator; a coin vault into which coins can be transferred from said escrow means; and means for so disenabling said escrow means that coins can be transferred directly from said slide means to said coin vault.

41. A sorter for coins and like objects comprising: an inclined, tilted slide, a rail extending along the lower side of said slide; means via which coins can be introduced onto said slide at the upper end thereof; and means for aligning said coins in single file and in sliding relationship to said slide and for guiding said coins to said rail which comprises a separator spanning said slide, means mounting said separator above said slide for rotation about an axis which is parallel to said slide and extends transversely thereacross, and motor means for rotating said separator in a forward direction corresponding to the direction of movement of the coins down said slide, said separator having: a first portion spanning the upper side of the slide which is of sufficient diameter to keep the objects being sorted from passing between it and the slide; a second portion spanning the downhill side of said slide of sufficiently small diameter to pass the objects being counted down said slide but narrow enough to keep two such objects from passing side-by-side therebeneath, said second portion also being sufficiently wide to pass the largest of the objects being counted and of sufficiently large diameter to keep coins piled one on the other from passing therebeneath; and means for dislodging from each other objects that reach the separator in side-by-side or superimposed relationship.

* * * * *